US008955844B2

(12) United States Patent
Takahata et al.

(10) Patent No.: US 8,955,844 B2
(45) Date of Patent: Feb. 17, 2015

(54) IMAGE READING APPARATUS

(71) Applicants: Muneaki Takahata, Toyoake (JP); Yoshinori Osakabe, Seto (JP); Hiromi Tanaka, Nagoya (JP); Takuya Naniwa, Kiyosu (JP)

(72) Inventors: Muneaki Takahata, Toyoake (JP); Yoshinori Osakabe, Seto (JP); Hiromi Tanaka, Nagoya (JP); Takuya Naniwa, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/081,516

(22) Filed: Nov. 15, 2013

(65) Prior Publication Data

US 2014/0138900 A1 May 22, 2014

(30) Foreign Application Priority Data

Nov. 16, 2012 (JP) ..... 2012-251876

(51) Int. Cl.
*B65H 39/10* (2006.01)
*B65H 5/26* (2006.01)
*B65H 7/02* (2006.01)

(52) U.S. Cl.
CPC ... *B65H 5/26* (2013.01); *B65H 7/02* (2013.01)
USPC ..... 271/303; 271/225

(58) Field of Classification Search
USPC ..... 271/65, 225, 301, 302, 303; 358/498
See application file for complete search history.

(56) References Cited

U.S. PATENT DOCUMENTS

| | | | | |
|---|---|---|---|---|
| 5,069,437 | A * | 12/1991 | Ishikawa | 271/3.03 |
| 5,553,528 | A * | 9/1996 | Zoltner | 83/443 |
| 6,953,192 | B2 * | 10/2005 | Jang | 271/213 |
| 8,610,975 | B2 * | 12/2013 | Osakabe | 358/498 |
| 8,695,976 | B2 * | 4/2014 | Takahata et al. | 271/303 |
| 2010/0149607 | A1 * | 6/2010 | Langrel et al. | 358/498 |
| 2011/0199654 | A1 * | 8/2011 | Takata | 358/498 |
| 2013/0083372 | A1 * | 4/2013 | Osakabe | 358/488 |
| 2013/0256981 | A1 * | 10/2013 | Takahata et al. | 271/225 |
| 2014/0138901 | A1 * | 5/2014 | Takahata et al. | 271/3.19 |
| 2014/0139896 | A1 * | 5/2014 | Osakabe et al. | 358/498 |

FOREIGN PATENT DOCUMENTS

| | | | |
|---|---|---|---|
| JP | 61-124467 | A | 6/1986 |
| JP | 61-269140 | A | 11/1986 |
| JP | 62-047565 | | 3/1987 |
| JP | 2-291352 | A | 12/1990 |
| JP | 8-133553 | A | 5/1996 |
| JP | 11-127301 | A | 5/1999 |
| JP | 2000-026003 | A | 1/2000 |
| JP | 2000-165594 | A | 6/2000 |
| JP | 2001-019255 | A | 1/2001 |
| JP | 2002-012354 | A | 1/2002 |
| JP | 2004-154975 | A | 6/2004 |
| JP | 2006-084569 | A | 3/2006 |
| JP | 2010-282077 | A | 12/2010 |
| JP | 2013-077259 | A | 4/2013 |

* cited by examiner

*Primary Examiner* — Jeremy R Severson
(74) *Attorney, Agent, or Firm* — Banner & Witcoff, Ltd.

(57) ABSTRACT

An image reading apparatus having a sheet path, which includes two ejection paths, is provided. The sheet path is switchable between the two ejection paths by a switchable member. An outlet cover arranged on a casing of the image reading apparatus is movable between a closed position and an open position to open and close an outlet of the second ejection path. When the outlet cover moves from the closed position to the open position, and before the switchable member switches the sheet path from the first ejection path to the second ejection path, switching of the sheet path from the first ejection path to the second ejection path is detectable.

5 Claims, 15 Drawing Sheets

IMAGE READING APPARATUS

CROSS REFERENCE TO RELATED APPLICATION

This application claims priority from Japanese Patent Application No. 2012-251876, filed on Nov. 16, 2012, the entire subject matter of which is incorporated herein by reference.

BACKGROUND

1. Technical Field

An aspect of the present invention relates to an image reading apparatus, which may be installed in a multifunction device (MFD) having a plurality of functions, such as a scanning function, a printing function, and a copying function.

2. Related Art

An MFD having a plurality of functions, such as a scanning function, a printing function and a copying function, may generally be equipped with an image reading apparatus configured to read an image from a sheet of original document. The image reading apparatus may include, for example, a so-called flatbed-typed image reading apparatus, which reads an image from the original document placed still on a so-called platen (e.g., a transparent plate of glass or resin). For another example, the image reading apparatus may be equipped with an auto-document feeder (ADF), which separates original documents placed on a document placement section automatically and conveys the separated original documents one-by-one, and reads images appearing on the separated original documents while the original documents are sequentially conveyed. Moreover, the flatbed-typed image reading apparatus may be equipped with the ADF.

The flatbed-typed image reading apparatus with the ADF may include a document feeder unit and a reader unit. The document feeder unit may be arranged on top of the reader unit, and the document feeder unit may generally be openable (and closable) with respect to the reader unit. Therefore, when a user attempts to have the image read from the original document placed still on the platen, which is arranged in an upper part of the reader unit, in other words, when the user selects not to use the document feeder unit, the user opens the document feeder unit with respect to the reader unit to place the original document on the platen manually. On the other hand, when the user selects to use the document feeder unit, the document feeder unit is not moved but is maintained closed with respect to the reader unit.

Meanwhile, the above-mentioned reader unit may be configured to form a document placement space, in which the original documents to be read are placed, and a document collecting space, in which the original documents having been read are collected. In order to reduce a space required for installation of the image reading apparatus, and in order to reduce dimensions of the image reading apparatus in depth and width, the document placement space and the document collecting space may be formed in vertically and at least partly overlapping arrangement with respect to each other. In other words, in a plane view, the document placement space and the document collecting space may at least partly overlap each other. While the document placement space and the document collecting space are continuous with each other via a document conveyer path, in order to enable the vertically overlapping arrangement, it is necessary that the document conveyer path includes a reversible path, which is curved upward or downward, and in which the original documents are inverted upside-down.

With the reversible path, when so-called regular paper, such as commercially available copier paper, is used as the original document to be read, the regular paper can be flexibly conveyed in the document conveyer path without difficulties. Meanwhile, when thicker paper, such as a postcard and business card, is used as the original document to be read, the thicker paper may be curled in the reversible path along the curvature.

Therefore, an ADF equipped with a regular conveyer path and a straight-formed different conveyer path may be suggested. The auto-document feeder may convey the regular paper in the regular conveyer path, which is formed to effectively reduce the installation space, and the thicker paper in the different straight conveyer path, so that the deformation of the thicker paper is avoided.

More specifically, the ADF may be equipped with the regular conveyer path, including straight paths and an upward curved path continuous with the straight conveyer paths. And in the regular conveyer path, the original document is conveyed from the document placement section arranged in a lower position to the document collecting section arranged in an upper position. At the same time, the ADF may be equipped with the straight-formed different conveyer path, which is branched from the regular conveyer path at an upstream position with respect to the curved path. The straight-formed different conveyer path may be formed to be narrower in width than a predetermined width so that a smaller-sized thicker paper with a width narrower than the predetermined width is guided correctly and allowed to pass there-through. In other words, the different conveyer path may allow the paper with a smaller width, which is narrower than the predetermined width, to pass there-through, while a larger-sized regular paper with a larger width, which is wider than the predetermined width, should be restricted from entering the different conveyer path.

In order to restrict the larger-sized wider paper from the different conveyer path and allow the smaller-sized narrower paper in the different conveyer path, the ADF may be provided with a rotatable member, which forms a part of the reversible path and may be rotatable to open and close entrance of the different conveyer path. The rotatable member may be rotated in conjunction with an ejection tray, which may be moved to open when used, and in which the smaller-sized narrower thicker paper should be collected.

If, however, the original document having a width wider than the predetermined width is placed on the placement section, and when the different conveyer path being narrower than the predetermined width is open to the wider original document, the wider original document may be drawn into the different conveyer path, of which width is narrower than the width of the wider original document. In this regard, the original document may be damaged or jammed in the different conveyer path.

SUMMARY

In the above-suggested ADF, the problem which may be caused by narrower different conveyer path with the wider original document has rarely been taken into consideration. Therefore, there have been risks that the original document with the width wider than the predetermined width may be forced into the narrower different conveyer path, and the forcibly conveyed original document may be damaged or jammed in the different conveyer path.

The present invention is advantageous in that an image reading apparatus, in which an original document can be restricted from being damaged or jammed in a conveyer path, is provided.

According to an aspect of the present invention, an image reading apparatus is provided. The image reading apparatus includes a casing having a sheet path, which includes a first ejection path and a second ejection path; a sheet placement section configured to receive a sheet to be read; an image reader configured to read an image from the sheet; a conveyer mechanism configured to convey the sheet from the sheet placement section through the image reader to one of the first ejection path and the second ejection path; an outlet cover arranged on the casing and configured to be movable between a closed position, in which an outlet of the second ejection path is closed by the outlet cover, and an open position, in which the outlet of the second ejection path is exposed; a path switchable member arranged in a branch point between the first ejection path and the second ejection path and configured to be movable to switch the sheet path for the sheet conveyed through the reader unit from one of the first ejection path and the second ejection path to the other of the first ejection path and the second ejection path; a signal output device configured to output signals including a first-typed signal and a second-typed signal being a different-typed signal from the first-typed signal, the signal output device being configured to output the first-typed signal when the outlet cover is in the closed position and to output the second-typed signal when the outlet cover is in the open position; a first movable unit arranged in a position between the outlet cover and path switchable member and configured to move the path switchable member in accordance with motions of the path switchable member moving between the open position and the closed position; and a second movable unit arranged in a position between the outlet cover and the signal output device and configured to move in accordance with the motions of the path switchable member moving between the open position and the closed position to switch the signals output from the signal output device from the first-typed signal to the second-typed signal. When the outlet cover starts moving from the closed position to the open position and before the sheet path is switched by the first movable unit moving the path switchable member from the first ejection path to the second ejection path, the second movable unit moves in accordance with the motion of the path switchable member to switch the signals to be output from the signal output device from the first-typed signal to the second-typed signal.

According to the configuration described above, the sheet can be restricted from being damaged or jammed in the sheet path.

BRIEF DESCRIPTION OF THE ACCOMPANYING DRAWINGS

DETAILED DESCRIPTION

Hereinafter, an MFD 1 being an image reading apparatus as an embodiment of the present invention having an ADF will be described with reference to the accompanying drawings. The image reading apparatus according to the present embodiment operates as a part of the MFD 1, which is equipped with a plurality of functions including a function as an image reading apparatus (i.e., a scanning function) and other functions (e.g., a printing function, a copying function and a facsimile transmission/receiving function). It is noted that various connections are set forth between elements in the following description. These connections in general, and unless specified otherwise, may be direct or indirect, and this specification is not intended to be limiting in this respect. Although an example of carrying out the invention will be described, those skilled in the art will appreciate that there are numerous variations and permutations of the image reading apparatus that fall within the scope of the invention as set forth in the appended claims. It is to be understood that the subject matter defined in the appended claims is not necessarily limited to the specific features or act described above. Rather, the specific features and acts described above are disclosed as example forms of implementing the claims.

In the embodiment described below, directions concerning the MFD 1 and each part included in the MFD will be referred to based on orientations indicated by arrows shown in each drawing. In this regard, a right-to-left or left-to-right direction of the MFD 1 may also be referred to as a right-left direction or a crosswise direction. An up-to-down or down-to-up direction corresponds to a vertical direction of the MFD 1. The front-to-rear or rear-to-front direction may be referred to as a front-rear direction or a direction of depth.

[External Configuration of the MFD]

Figure 1:
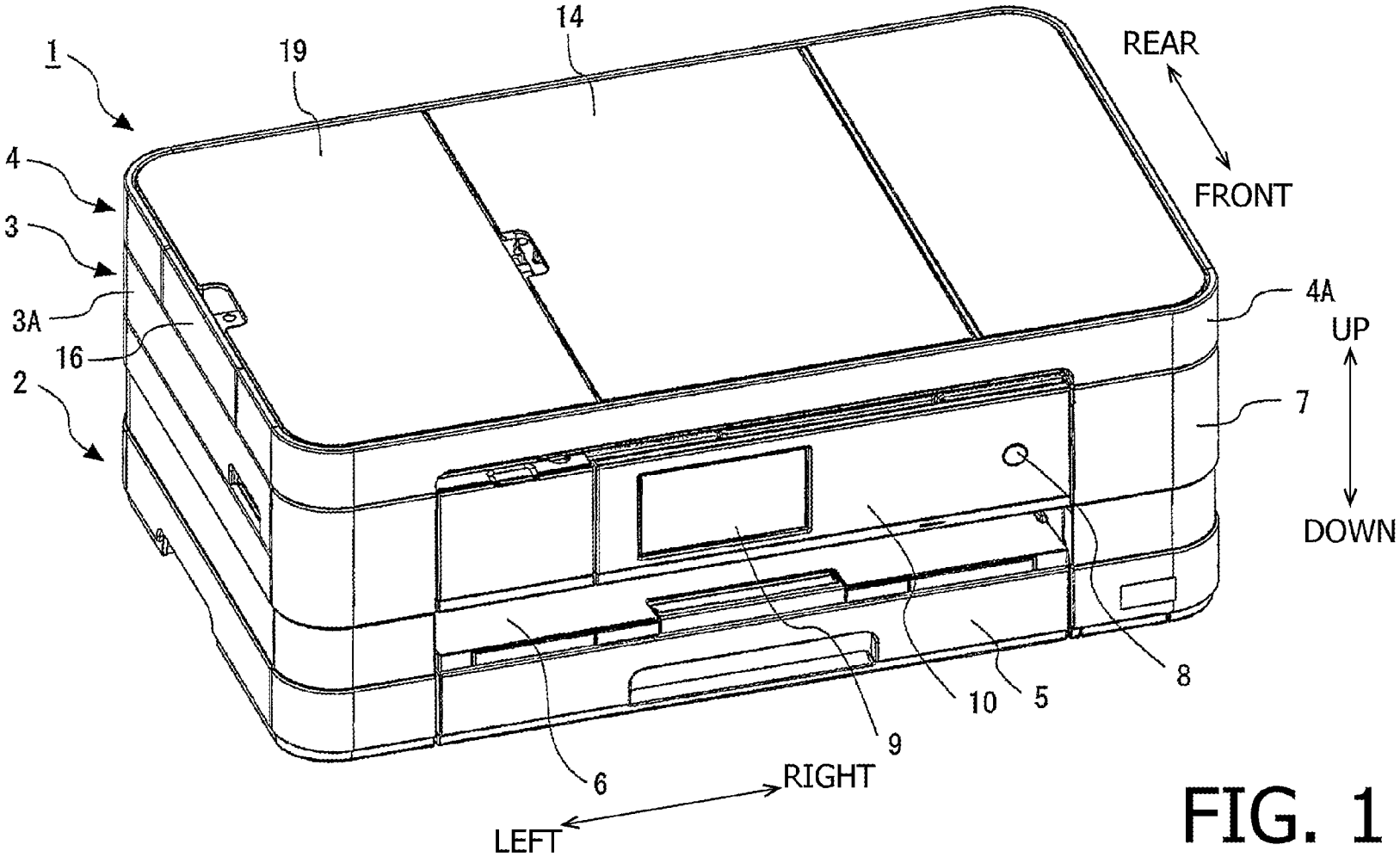
FIG. 1 is an overall perspective view of an MFD being an example of an image reading apparatus having an ADF according to an embodiment of the present invention.

As depicted in FIG. 1, the MFD 1 includes a main unit 2, a reader unit 3 and a document conveyer unit 4. The reader unit 3 is arranged in an upper position with respect to the main unit 2. The document conveyer unit 4 is arranged in an upper position with respect to the reader unit 3.

The main unit 2 includes function units such as an image forming unit, a controller unit and a power unit, which are not shown but may substantially be used for image recording operations. The controller unit in the main unit 2 controls behaviors of various driving mechanisms disposed in the main unit 2, the reader unit 3 and the document conveyer unit 4. On a front side of the main unit 2, which appears on a lower-right side in FIG. 1, an opening 6 is formed. Through the opening 6, a sheet-feed cassette 5, in which a plurality of recording sheets can be stored, is detachably attached to the main unit 2. On the front side of the main unit 2, further, a front cover 7 and an operation unit 10 are arranged. The operation unit 10 includes a main power switch 8 and a touch-sensitive liquid crystal display panel 9.

Figure 2:
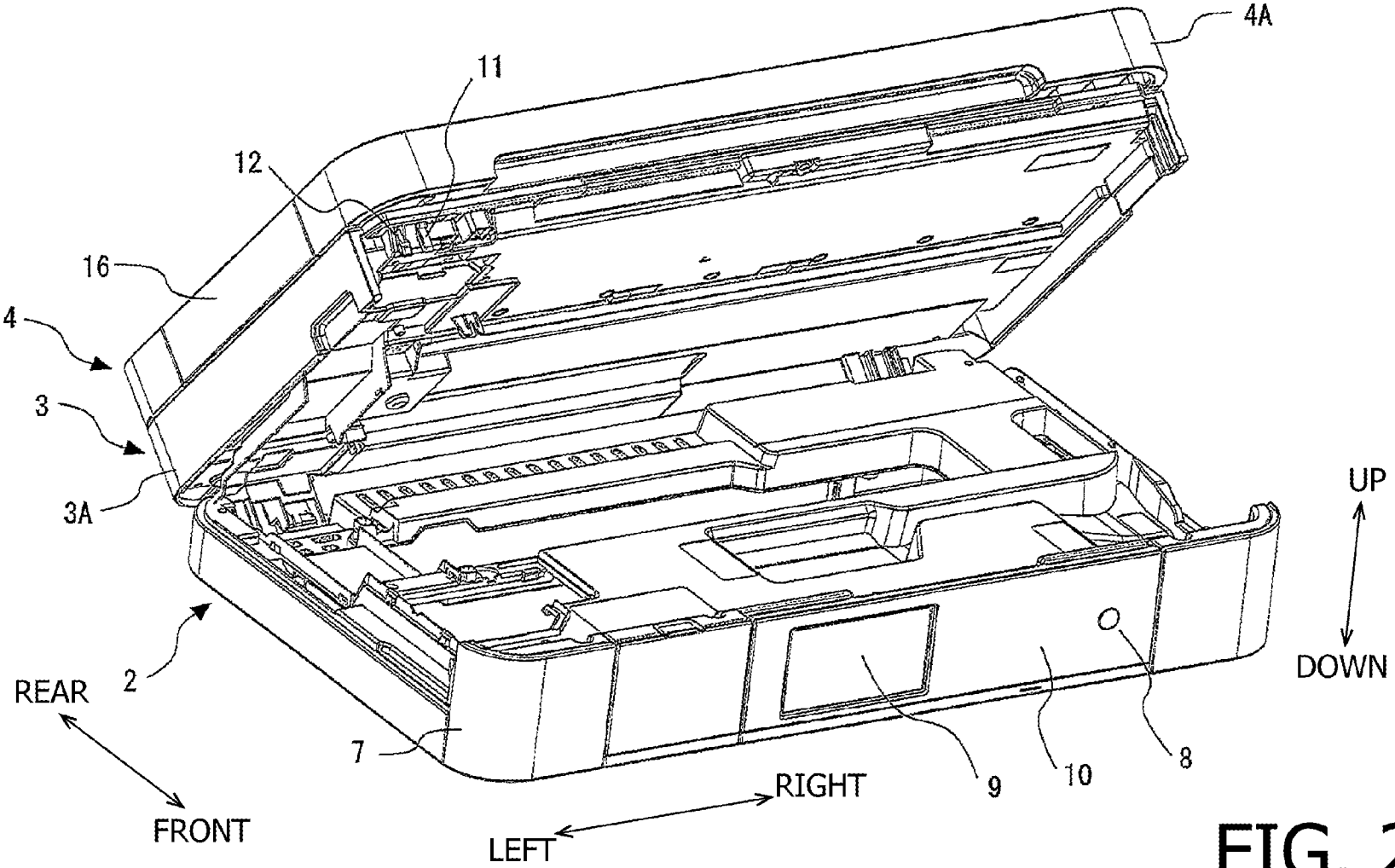
FIG. 2 is a perspective view of the MFD according to the embodiment of the present invention with a reader unit being open with respect to a main unit.

The reader unit 3 is rotatable with respect to the main unit 2 about a rotation axis, which extends along the crosswise direction at a rear end (i.e., an upper left side in FIG. 1) of the main unit 2 and the reader unit 3. Therefore, the reader unit 3 is movable to rotate between a closed position, which is shown in FIG. 1, and an open position, which is shown in FIG. 2. FIG. 2 shows the reader unit 3 having been moved to the open position together with the document conveyer unit 4.

As depicted in FIG. 2, when the reader unit 3 is moved to the open position, an upper part of the main unit 2 is exposed. Therefore, the user can access an internal structure inside the main unit 2 and, for example, easily remove a recording sheet jammed during an image recording operation in the main unit 2. Further, an operator can provide maintaining works to the image forming unit, the controller and the power unit installed in the main unit 2. In a leftward front position in the reader unit 3, two sensor-manipulative tips 11, 12 are arranged. When the user moves the reader unit 3 from the closed position shown in FIG. 1 to the open position shown in FIG. 2, the sensor-manipulative tips 11, 12 are separated from two motion-detective sensors 11A, 12A provided to the main unit 2 respectively (see FIGS. 8 and 9). Functions and mechanisms of the motion-detective sensors 11A, 12A and the sensor-manipulative tips 11, 12 will be described in detail later.

Figure 3:
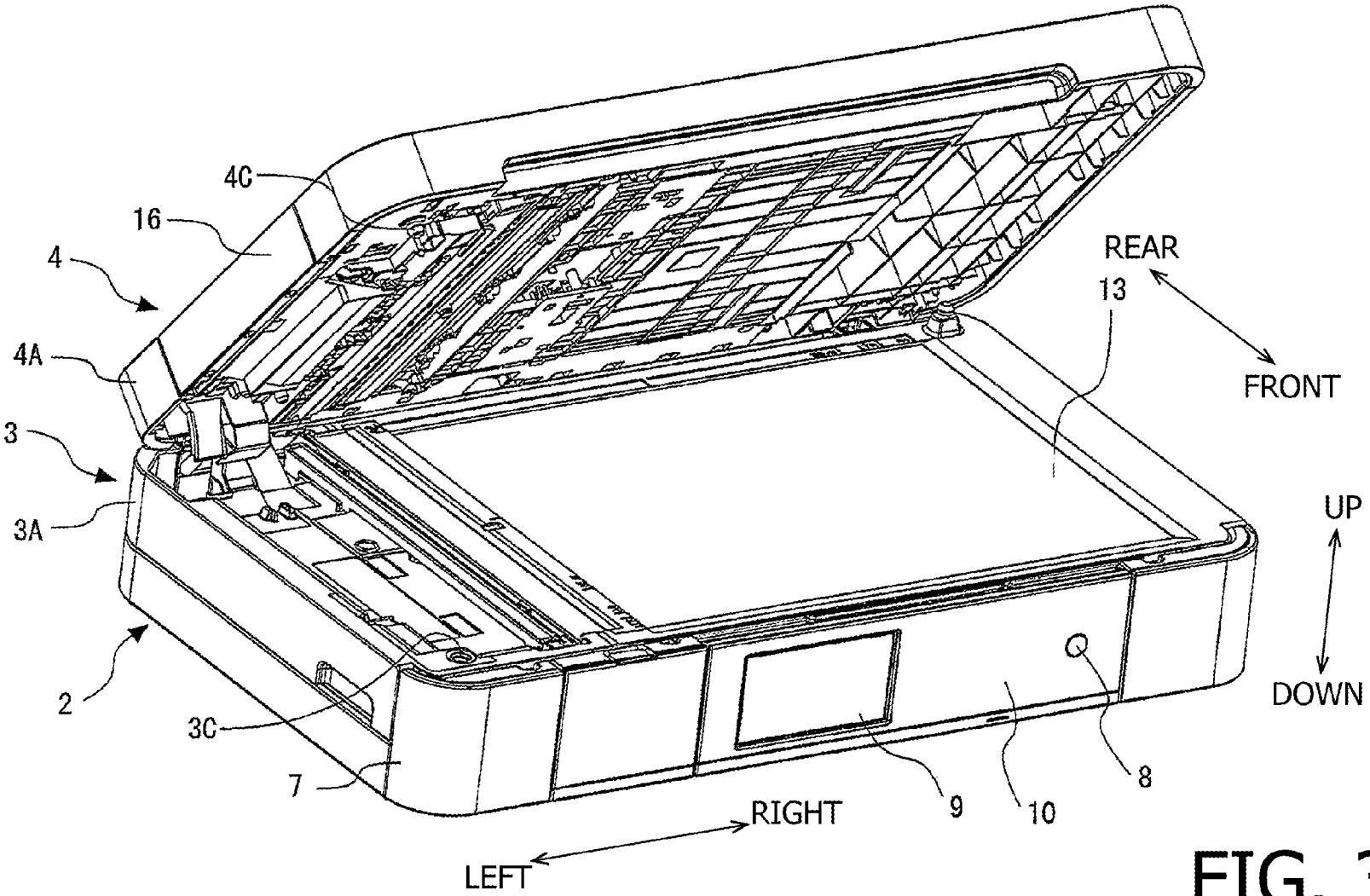
FIG. 3 is a perspective view of the MFD according to the embodiment of the present invention with a document conveyer unit being open with respect to the reader unit.

The document conveyer unit 4 is rotatable with respect to the reader unit 3 about a rotation axis, which extends along the crosswise direction (the right-left direction) at a rear end of the reader unit and the document conveyer unit 4. Therefore, the document conveyer unit 4 is movable to rotate between a closed position, which is shown in FIG. 1, and an open position, which is shown in FIG. 3. When the user moves the document conveyer unit 4 from the closed position to the open position, a platen 13 arranged on top of the reader unit 3 is exposed. The platen 13 forms a document placement plane and is made of, for example, transparent glass. When the document conveyer unit 4 is in the closed position, the document conveyer unit 4 covers a top surface of the platen 13.

Figure 4:
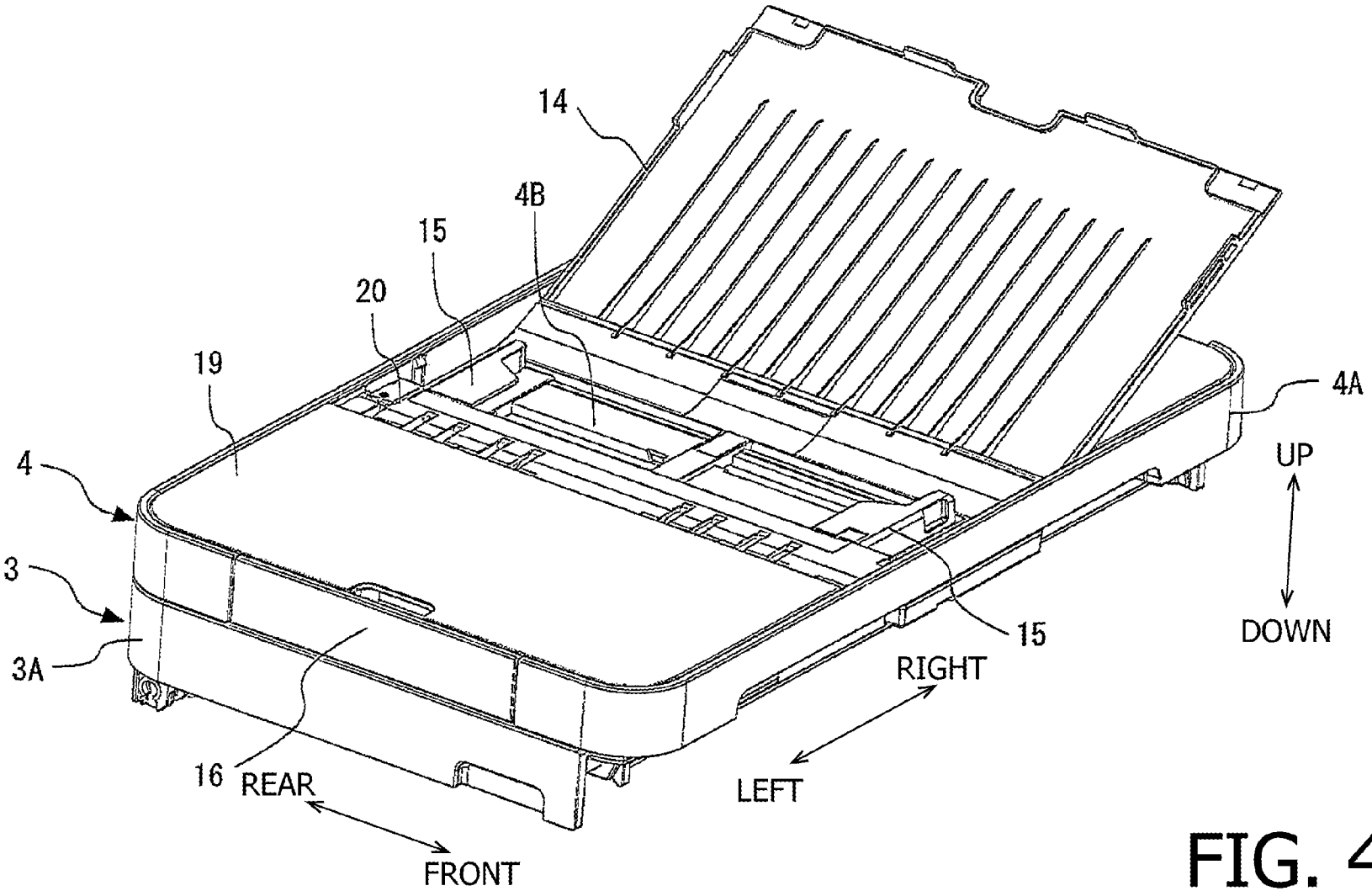
FIG. 4 is a perspective view of the document conveyer unit of the MFD according to the embodiment of the present invention with a document placement cover being open.

In a central area on top of the document conveyer unit 4, an openable/closable document placement cover 14 is disposed. As depicted in FIG. 4, when the document placement cover 14 is open, the document placement cover 14 serves as a document placement tray. The document placement tray serves as a part of a document placement section, in which original documents to be read can be placed by the user. In other words, the original documents provided by the user are received in the document placement section. The document conveyer unit 4 includes a pair of guiding pieces 15. The pair of guiding pieces 15 are arranged to contact two widthwise sides of the original documents, which extend orthogonally with respect to a conveying direction of the original documents, to guide the original documents and restrict the original documents being conveyed from skewing. The pair of guiding pieces 15 are movable in conjunction with each other to be closer to and farther from each other. The pair of guiding pieces 15 are movable continually between a maximum-width positions, in which a predetermined larger-sized original document (e.g., an A4-sized sheet or a letter-sized sheet) can be guided (see FIG. 4), and a minimum-width positions, in which a predetermined smaller-sized original document (e.g., a business card) can be guided (see FIG. 5). The paired guiding pieces 15 may not necessarily be movable continually but may be movable gradually step-by-step so that the paired guiding pieces 15 may be guided to fall in one of predetermined positions corresponding to standardized document sizes between the maximum-width positions and the minimum-width positions. According to the present embodiment, a width of an original document may refer to a dimension of the original document, placed on the placement section to be conveyed in the document conveyer unit 4, along the front-rear direction. A width of the original document placed on the document placement section is detected and judged whether the detected width of the original document is greater than or equal to a predetermined width or smaller than the predetermined width. The width of the original document placed on the document placement section may be detected by, for example, a width-detectable switch or a sensor, which can detect a distance between the paired guiding pieces 15. For another example, a predetermined switch or a sensor to detect a size of the original document placed on the document placement section and judge whether the detected size of the original document is greater than or equal to a predetermined size or smaller than the predetermined size, independently from the distance between the paired guiding pieces 15, may be provided. In the following description, the switch and the sensor to detect the width of the original documents will be represented by a term "sensor."

In the present embodiment, unless the user specifically enters a size or a width of the original document to be read through the operation unit 10, necessity to use an outlet cover 16 is determined based on a detected result obtained from the sensor (not shown), which detects whether the width of the original document placed on the document placement section is greater than or equal to a predetermined threshold width or smaller than the predetermined threshold width. The outlet cover 16 will be described later. According to the present embodiment, if the original documents are postcards or business cards, which are in substantially industry-standardized sizes and have substantial thicknesses, except for an irregular-formatted original document, the outlet cover 16 is used. Therefore, it is necessary that the sensor should detect whether the width of the original document placed on the placement section is greater than or equal to the width of a standardized postcard-size (e.g., 148 mm) or smaller than the standardized postcard-size. A result detected by the sensor is passed to the controller unit in the main unit 2. The width of the original document being smaller than or equal to the predetermined threshold width may be detected by a known placement-sensitive sensor, which can detect an original document placed on the document placement section, while the width of the original document being greater than the predetermined threshold width may be detected by an additional sensor, which is arranged to detect the greater portion of the original document spreading beyond the predetermined threshold width.

In one embodiment, the sensor may distinctively detect the original document having a width which is smaller than or equal to a dimension of longer sides of the standardized postcard-size (e.g., 148 mm) and the original documents having a width which is greater than or equal to a dimension of shorter sides of a standardized B5-size (e.g., 182 mm); in other words, the threshold width may have a range, which is between 148 mm and 182 mm, in a reason described below. Namely, a dimension of shorter sides of the standardized A5 size, which is a size smaller than standardized A4 size, is 148 mm, which is the same dimension as the longer sides of the postcard-size. Meanwhile, a dimension of shorter sides of standardized B6 size, which is smaller than the standardized B5 size, is 128.5 mm. In other words, as long as the standardized sizes are concerned, there may not be an original document having a width between 148 mm and 182 mm; therefore, it is not necessary to consider an original document having a width greater than 148 mm and smaller than 182 mm. Meanwhile, in the present embodiment, 148 mm being the dimension of the longer sides of the standardized postcard-size is set as the threshold width, and an original document having a width smaller than 148 mm is determined to be smaller than or equal to the predetermined width, and an original document having a width greater than the threshold width is determined to be larger than the predetermined width.

Figure 5:
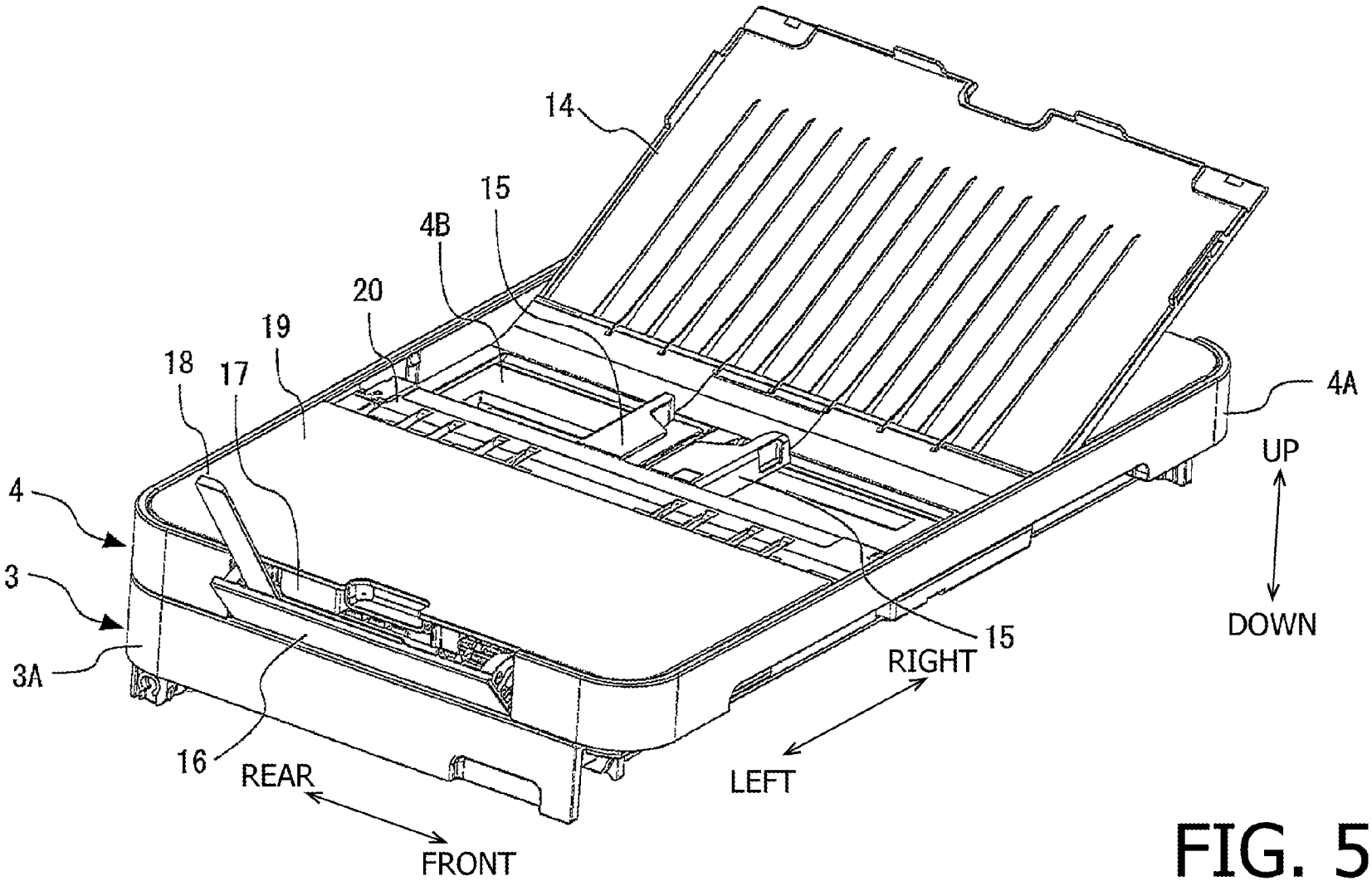
FIG. 5 is a perspective view of the document conveyer unit of the MFD according to the embodiment of the present invention with an outlet cover being open.
Figure 6:
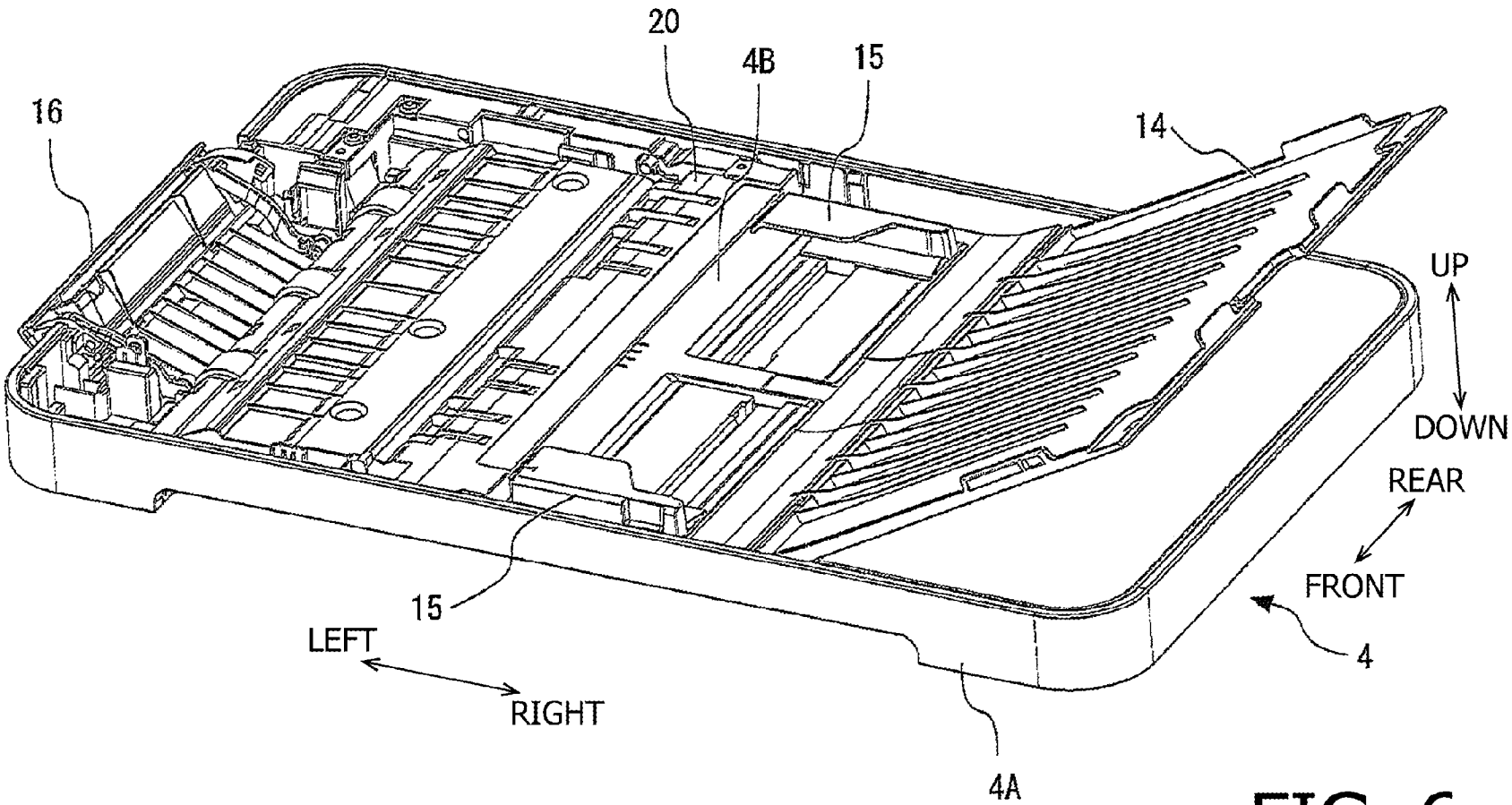
FIG. 6 is a perspective view of the document conveyer unit of the MFD according to the embodiment of the present invention with an ADF cover being removed and the outlet cover being open.

On one lateral side of the document conveyer unit 4, in a central position along the front-rear direction, the outlet cover 16, on which the original documents having been read and ejected are collected, is arranged. The outlet cover 16 is rotatable about an axis, which extends along the widthwise direction of the original document to be ejected, i.e., the front-rear direction, at a lower end thereof. The outlet cover 16 is rotatable to move between a closed position (see FIG. 1) and an open position (see FIGS. 5 and 6). When the outlet cover 16 is in the open position, a document outlet 17, through which the original document with a width smaller than the predetermined threshold width is ejected, is exposed. When the outlet cover 16 is in the closed position, the document outlet 17 is covered. The document outlet 17 is formed on the lateral side of a casing 4A of the conveyer unit 4. Further, as depicted in FIG. 5, the outlet cover 16 is equipped with a storable support arm 18 to support, for example, ejected postcards. Moreover, an ADF cover 19 is arranged on one side along the crosswise direction and an upper position in the document conveyer unit 4. The ADF cover 19 is closed in an ordinary condition to cover the upper part of the document conveyer unit 4 but is opened to expose internal structures when maintaining works are provided and when the original document being conveyed is jammed inside the ADF cover 19. As depicted in FIG. 6, when the ADF cover 19 is removed, the upper part of the document conveyer unit 4 is exposed, and the user can access the internal components for maintenance and remove the jammed original document. The ADF cover 19 may be in an openable/closable structure or a removable/attachable structure. The above-mentioned sensor, which can detect presence of the original document placed on the document placement section, and the sensor, which can detect the width of the placed original document, are arranged in lower positions with respect to an upper document cover 20. In the present embodiment, when the original documents are placed in between the paired guiding pieces 15, while the paired guiding pieces 15 are separated from each other, leading ends of the original document are inserted in an area underneath the upper document cover 20 to be drawn inside the document conveyer unit 4. After being reversed upside-down in the document conveyer unit 4, the original documents are collected in an area between the ADF cover 19 and the upper document cover 20. The behaviors of the document conveyer unit 4 will be described later in detail.

[Detailed Configurations of the Reader Unit 3 and the Document Conveyer Unit 4]

Next, detailed configurations of the reader unit 3 and the document conveyer unit 4 will be described with reference to FIGS. 8 and 9. In the following description, according to a flow of conveying the original document, which is indicated by thicker (solid and double-dotted) arrows in FIGS. 8 and 9, a side closer to an origin of the flow will be referred to as an upstream side along a conveying direction, and a side closer to an end of the flow will be referred to as a downstream side along the conveying direction.

Figure 8:
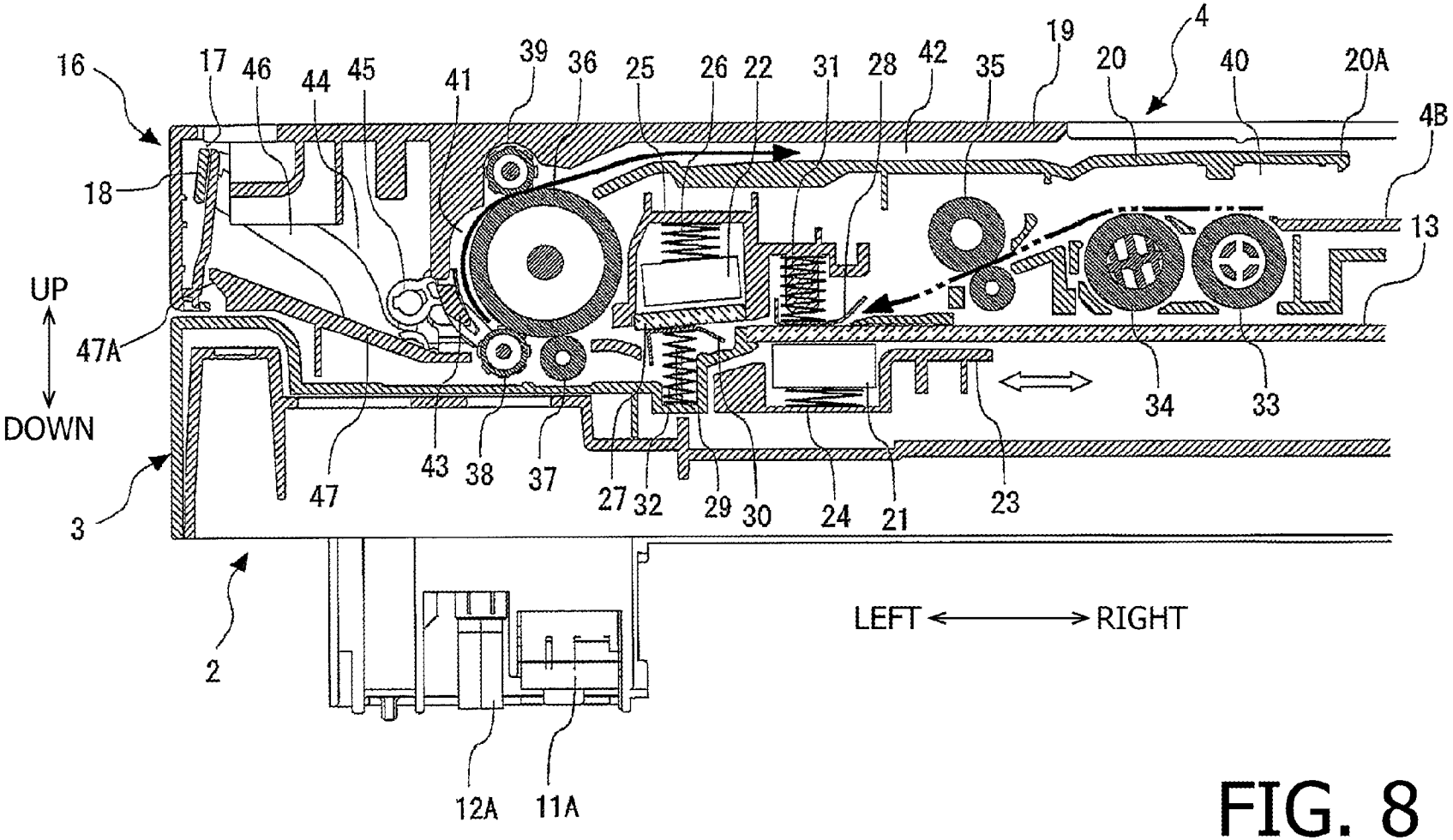
FIG. 8 is a cross-sectional partial view of the document conveyer unit with the outlet cover being closed in the MFD according to the embodiment of the present invention.
Figure 9:
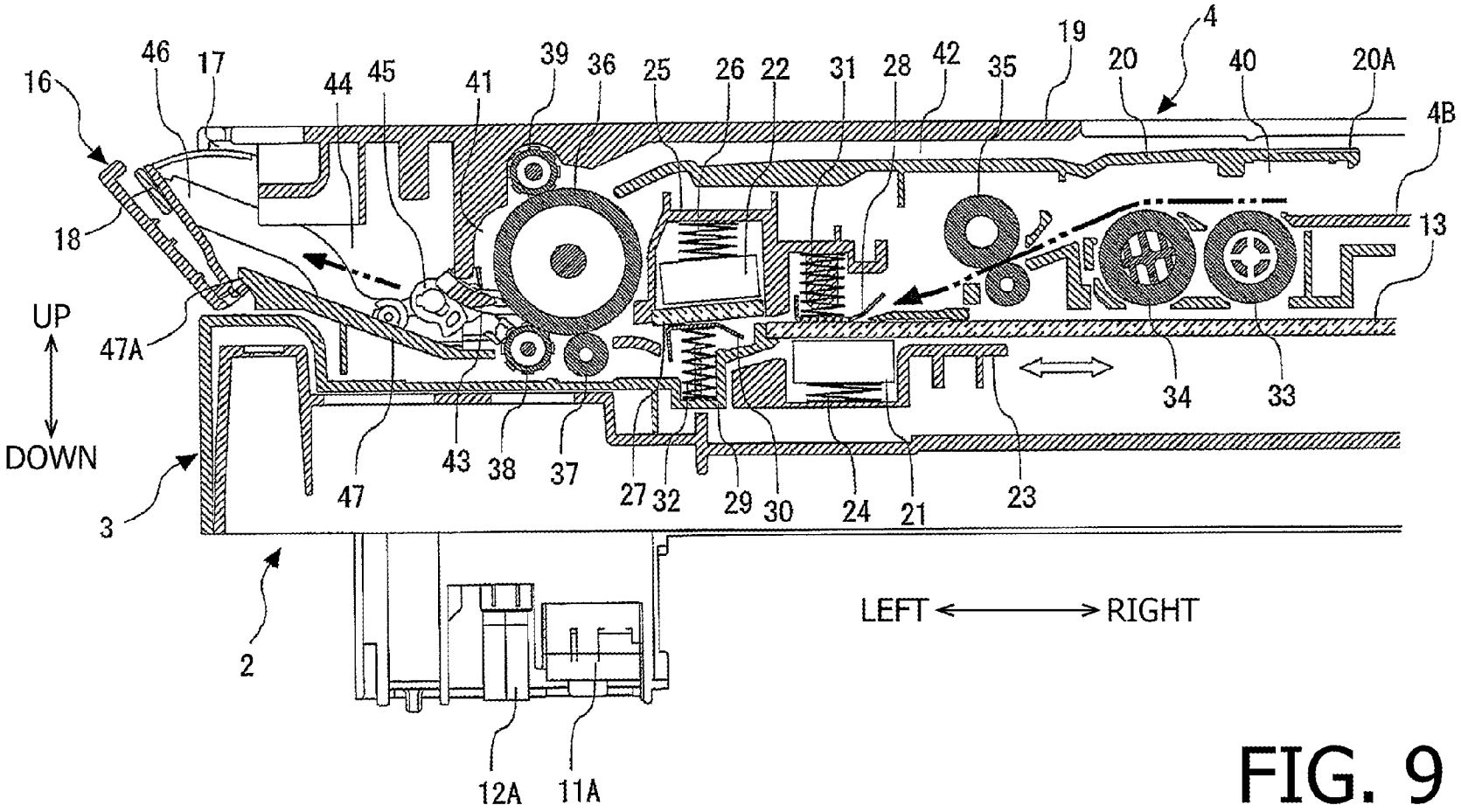
FIG. 9 is a cross-sectional partial view of the document conveyer unit with the outlet cover being open in the MFD according to the embodiment of the present invention.

As depicted in FIGS. 8 and 9, the reader unit 3 includes a first image sensor 21 in a lower position with respect to the platen 13. Meanwhile, the document conveyer unit 4 includes a second image sensor 22. When the document conveyer unit 4 is closed with respect to the reader unit 3, the second image sensor 22 is in a downstream position along the conveying direction of the original document with respect to the first image sensor 21. In the present embodiment, contact image sensors are employed to serve as the first image sensor 21 and the second image sensor 22.

The first image sensor 21 is held in a holder 23, which is moved by a motor (not shown) to reciprocate inside the reader unit 3 along the crosswise direction (the right-left direction), and is urged toward the platen 13 by a buffer 24, such as a coil spring, at all times. The second image sensor 22 is held in a holder frame 25 in the document conveyer unit 4 and is urged toward a second platen 27 by a buffer 26, such as a coil spring, at all times. The second platen 27 is held by the holder frame 25.

The first image sensor 21, with the platen 13 arranged in an upper position thereof, is arranged in an upward-facing posture to read the image on the original document being in an upper position. The second image sensor 22, with the second plate 27 arranged in a lower position thereof, is arranged in a downward-facing posture to read an image on the original document being in a lower position. In an upper position with respect to the first image sensor 21, a first document presser 28 is arranged. More specifically, the first document presser 28 is held by the holder frame 25 in the document conveyer unit 4 and arranged in a position opposite from the first image sensor 21 across the platen 13. Meanwhile, in a lower position with respect to the second image sensor 22, a second document presser 30 is arranged. More specifically, the second document presser 30 is held by a holder frame 29 in the reader unit 3 and arranged in a position opposite from the second image sensor 22 across the second platen 27. The first document presser 28 is urged by an urging member 31 such as a compression spring toward the platen 13. The second document presser 30 is urged by an urging member 32 such as a compression spring toward the second platen 27. Thereby, the first document presser 28 is in a condition to substantially press an upper surface of the platen 13, and the second document presser 30 is in a condition to substantially press a lower surface of the second platen 27.

In lower positions with respect to the upper document cover 20 in the document conveyer unit 4, parts constituting a conveyer mechanism are arranged. More specifically, a document feed roller 33, a separator roller 34 and paired conveyer rollers 35 are disposed. Further, on a downstream side with respect to the second image sensor 22 along the conveying direction, a turnaround-driving roller 36 and a plurality of turnaround-driven rollers 37, 38, 39 are arranged. The turnaround driving roller 36 conveys and inverts the original document. The plurality of turnaround-driven rollers 37, 38, 39 are arranged in peripheral positions around the turnaround-driving roller 36 and nip the original document in conjunction with the turnaround-driving roller 36 to convey the original document.

A path extending from an intervening position, between an upstream end 20A of the upper document cover 20 and a document placement surface 4B of the document conveyer unit 4, to an intervening position, between the turnaround-driving roller 36 and the turnaround-driven roller 37, along an intervening position between the first document presser 28 and the platen 13 and an intervening position between the second document presser 30 and the second platen 27, forms a document reading path 40. Meanwhile, a path extending from the intervening position between the turnaround-driving roller 36 and the turnaround driven roller 37 to an intervening position between the turnaround-driving roller 36 and the turnaround-driven roller 39 forms a reversible path 41. Further, a path extending from the intervening position, between the turnaround-driving roller 36 and the turnaround-driven roller 39 to an intervening position between the ADF cover 19 and the upper document cover 20 forms a document ejection path 42. Furthermore, in a midst position in the document reversible path 41, more specifically, in an intermediate position between the turnaround-driven roller 37 and the turnaround-driven roller 38, a flapper 43 movably is disposed. The flapper 43 is movable to rotate in conjunction with opening/closing motions of the outlet cover 16 and switches the paths to be taken by the original document.

The flapper 43 is arranged in a position in proximity to the turnaround-driven roller 38. As depicted in FIG. 8, when the outlet cover 16 is shut to cover the document outlet 17, the flapper 43 releases a downstream part of the document reversible path 41 with respect to the turnaround-driven roller 38. Therefore, the original document having been conveyed in the document reading path 40 and read, at least, by the first image sensor 21 and, additionally, by the second image sensor 22, is reversed upside-down in the document reversible path 41 and conveyed to the document ejection path 42. When the outlet cover 16 exposes the document outlet 17, as depicted in FIG. 9, the flapper 43 closes the downstream part of document reversible path 41 with respect to the turnaround-driven roller 38. Therefore, the original document having been conveyed in the document reading path 40 and read, at least, by the first image sensor 21 and, additionally, by the second image sensor 22, is conveyed to a second ejection path 44, which extends from the flapper 43 to the outlet cover 16. Thus, the flapper 43 is arranged in a branch point between the document reversible path 41 and the second ejection path 44.

The flapper 43 has, as mentioned above, a rotatable structure, which enables the flapper 43 to rotate with respect to the other parts in the document conveyer unit 4. Thereby, the flapper 43 is movable to rotate between a turnaround-open position (see FIG. 8) and a turnaround-closed position (see FIG. 9). The turnaround-open position of the flapper 43 is a position, in which the flapper 43 releases the document reversible path 41. The turnaround-closed position is a position, in which the flapper 43 closes the document reversible path 41.

Figure 10:
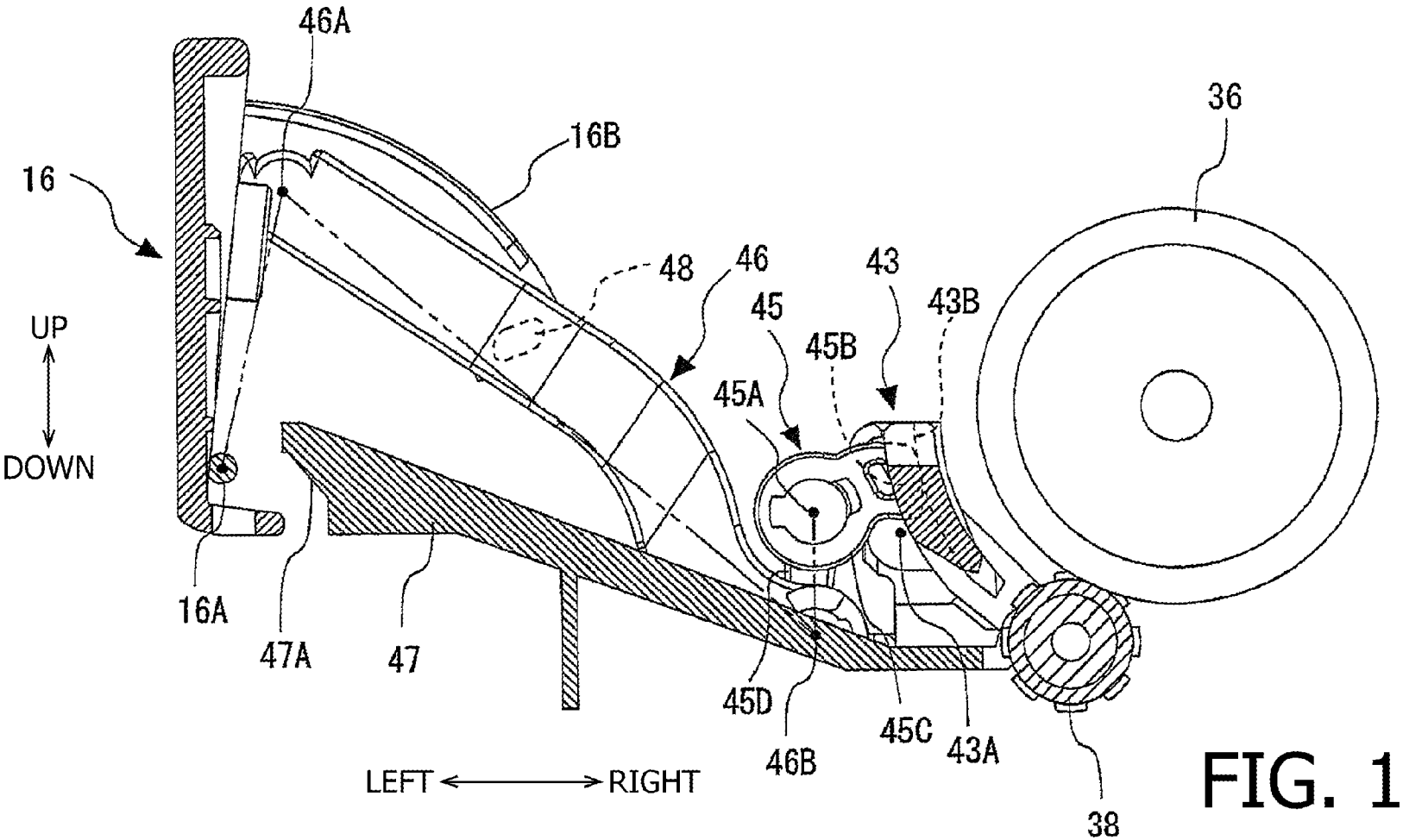
FIG. 10 is an illustrative view of a rotatable mechanism of a flapper when the outlet cover is closed in the MFD according to the embodiment of the present invention.
Figure 11:
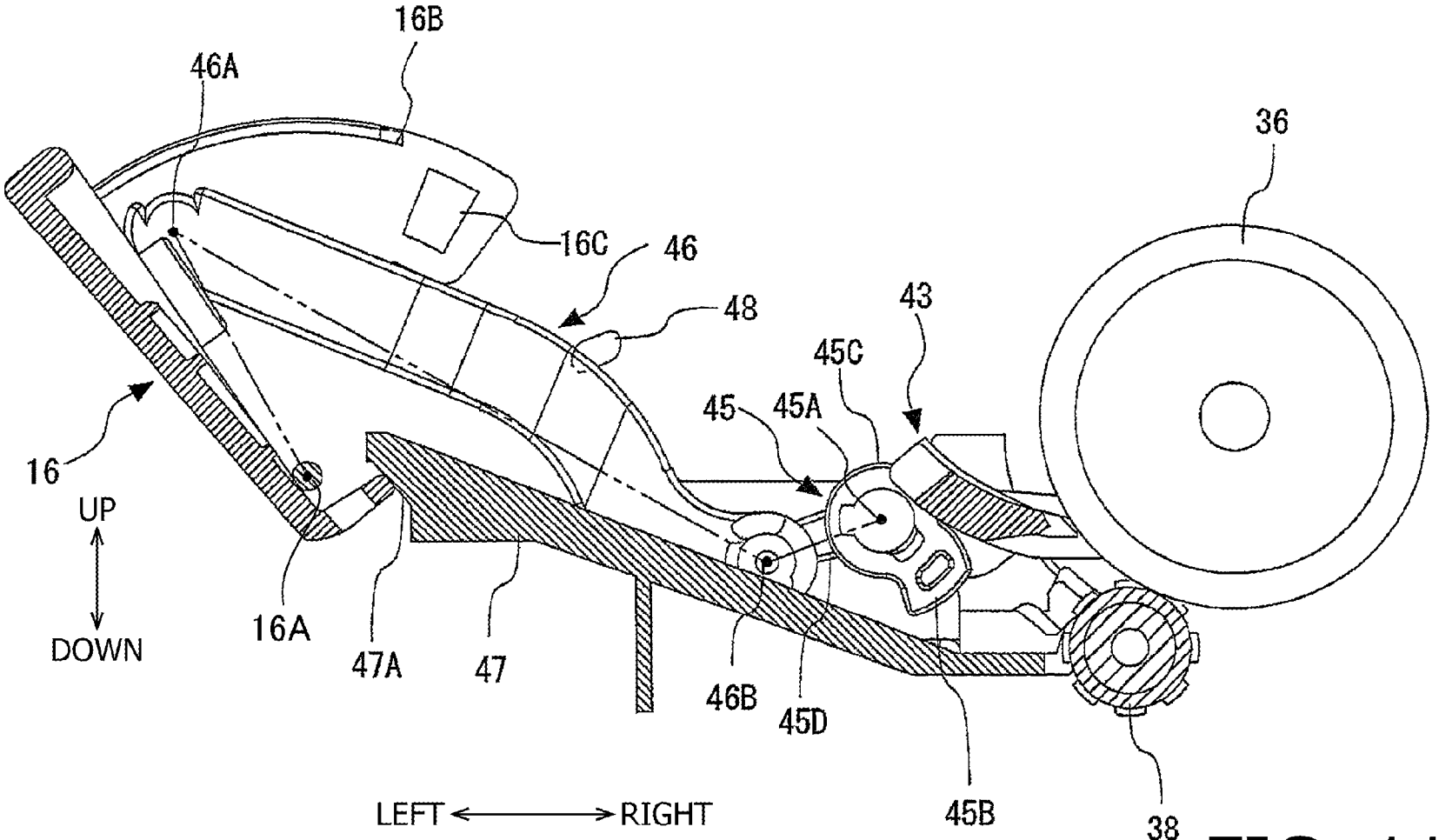
FIG. 11 is an illustrative view of the rotatable mechanism of the flapper when the outlet cover is open in the MFD according to the embodiment of the present invention.
Figure 12:
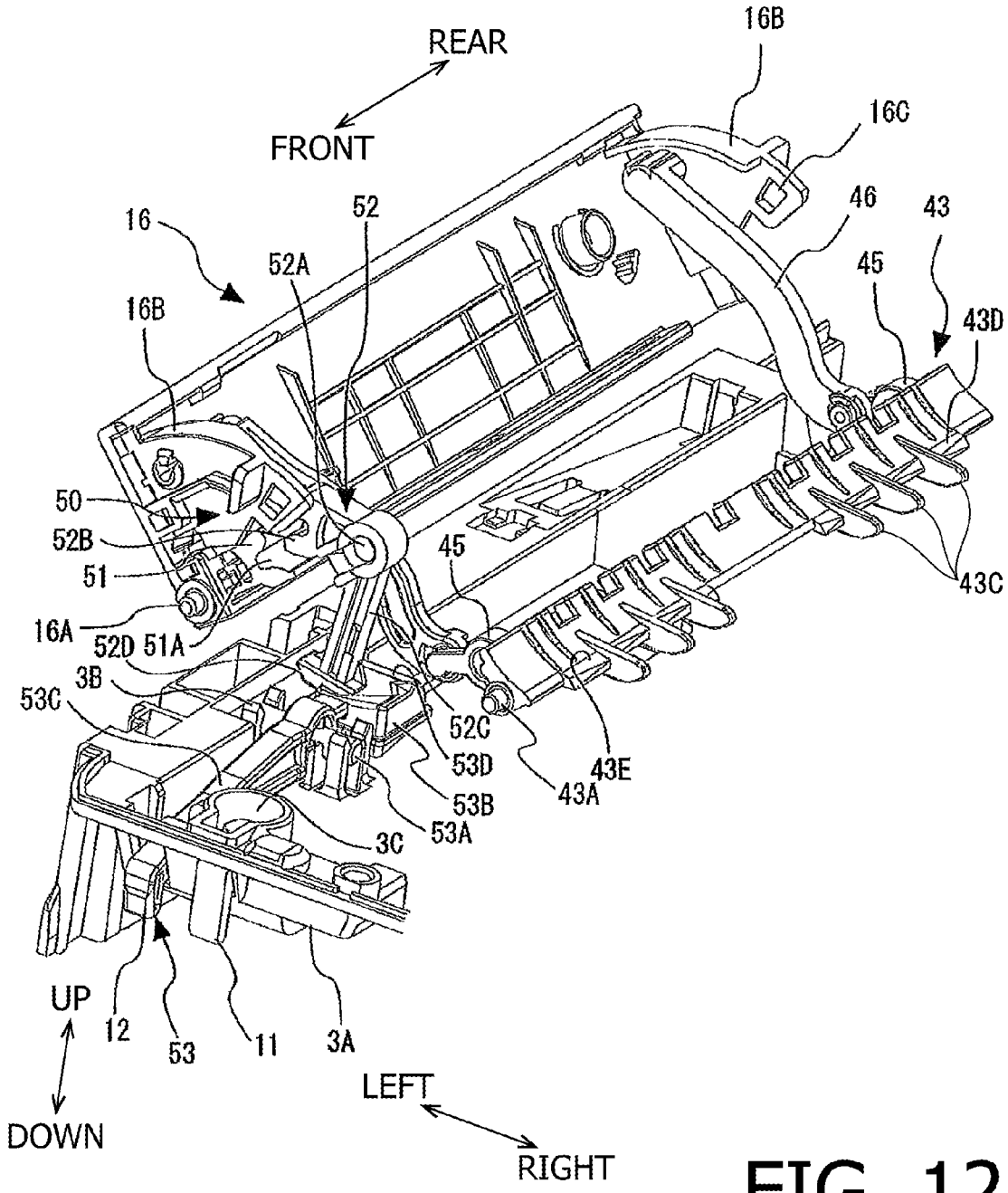
FIG. 12 is an illustrative view of movable parts, which are to be moved in conjunction with an opening motion of the outlet cover, in the MFD according to the embodiment of the present invention.

The flapper 43 is, as depicted in FIGS. 10-12, movable to rotate in conjunction with opening and closing motions of the outlet cover 16 via a cam 45 and an arm 46. The cam 45 is axially supported by a supporting part (not shown) formed in a guide plate 47. In other words, a position of a rotation axis A of the cam 45 is steady and immovable. Meanwhile, the flapper 43 is urged toward the cam 45 by a coil spring (not shown) at all times. More specifically, the flapper 43 is urged against one of a first cam surface 45B and a second cam surface 45C at all times. The cam 45 and the arm 46 are arranged in positions between the outlet cover 16 and the flapper 43. Thereby, the opening and closing motions of the outlet cover 16 are transmitted to the flapper 43 to move the flapper 43.

When the flapper 43 is in the turnaround-open position, a first ejection path extending from the document reversible path 41 to the document ejection path 42 is established (see FIG. 8). On the other hand, when the flapper 43 is in the turnaround-closed position, a second ejection path 44 is released (see FIG. 9). The second ejection path 44 extends substantially linearly, in a cross-sectional view, or straight from the document reading path 40; therefore, the original document can be conveyed substantially in a flat posture without being curled compared to the original document being conveyed in the first ejection path.

As depicted in FIG. 10, the flapper 43 is rotatably supported by the document conveyer unit 4 to rotate about a rotation axis 43A. The rotation axis 43A of the flapper 43 is fixed in a lower position with respect to a rotation axis of the turnaround-driving roller 36 and in an upstream position with respect to the rotation axis 45A of the cam 45.

The cam 45 is rotatably supported by the document conveyer unit 4 to rotate about the rotation axis 45A. The cam 45 is formed to have the first cam surface 45 and the second cam surface 45 on a circumference thereof. The first cam surface 45B spreads in parallel with the rotation axis 45A equidistantly from the rotation axis 45A, e.g., in a shape of a part of a circumferential surface of a cylinder or an arc. The second cam surface 45C spreads in parallel with the rotation axis 45A equidistantly from the rotation axis 45A, e.g., in a shape of a part of a circumferential surface of a cylinder or an arc. Thus, the first cam surface 45B and the second cam surface 45C spreads coaxially; however, the distance between the first cam surface 45B and the rotation axis 45A and the distance between the second cam surface 45B and the rotation axis 45A are different. In the present embodiment, the distance between the first cam surface 45B and the rotation axis 45A is greater than the distance between the second cam surface 45C and the rotation axis 45A; in other words, the first cam surface 45B is distanced apart from the rotation axis 45A than the second cam 45C.

The flapper 43 is formed to have a contact surface 43B, at which the flapper 43 contacts the cam 45. The contact surface 43B contacting one of the first cam surface 45B and the second cam surface 45C provides pressing force from the contact position toward the rotation axis 45A of the cam 45. In this regard, due to the direction of the pressing force, the cam 45 is not rotated by the pressing force from the contact surface 43B.

Meanwhile, a position, in which the first cam surface 45B contacts the contact surface 43B is in a downstream position in the first ejection path with respect to the rotation axis 43A of the flapper 43. With the first cam surface 45B contacting the contact surface 43B in the downstream position, a force from the flapper 43 to affect the cam 45 while the original document is conveyed in the document reversible path 41 is reduced to be smaller, compared to a force from the flapper 43 to affect the cam 45 if the first cam surface 45B contacts the contact surface 43B at a position closer to the rotation axis 43A of the flapper 43.

The cam 45 is formed to have an extended part 45D, which extends to be elongated from the rotation axis 45A. An end of the extended part 45D is rotatably coupled with one end of the arm 46 to mutually rotate about a rotation axis 46B. The arm 46 is rotatably coupled with the outlet cover 16 at the other end to rotate about a rotation axis 46A.

The outlet cover 16 is rotatably supported by the document conveyer unit 4 to rotate about a rotation shaft 16A, which is arranged in a lower position of the outlet cover 16. Thereby, the outlet cover 16 being rotated exposes or covers the document outlet 17, which is formed in a casing 4A of the document conveyer unit 4. At each end of the outlet cover 16 along the front-rear direction, a sector piece 16B spreading inwardly along the crosswise direction (the right-left direction) in the document conveyer unit 4 is arranged. Each sector piece 16B is formed to have an engageable hole 16C at a right-side end thereof.

The engageable hole 16C is engageable with an engagement chip 48, which is formed in the document conveyer unit 4, when the outlet cover 16 is in the closed position. By the engagement of the engageable hole 16C with the engagement chip 48, the outlet cover 16 can be maintained in the closed position. The engagement of the engageable hole 16C with the engagement chip 48 should be substantially firm to prevent the outlet cover 16 from moving easily by its own weight to the open position and should be easily disengaged by the user when the user attempts to open the outlet cover 16 manually.

As depicted in FIG. 12, in lower positions in the flapper 43, pectinate teeth 43C are formed. In base parts of the pectinate tooth 43, a tossing surface 43D and a tossing surface 43E are formed. The tossing surface 43D is formed to have a slope, by which a leading end of the original document being conveyed is directed upward, when the original document with the leading end thereof being bent downward contacts the slope of the tossing surface 43D. The tossing surface 43E is formed to have a slope, by which a leading end of the original document being conveyed is directed upward, when the original document with the leading end thereof being bent downward contacts the slope of the tossing surface 43E.

The outlet cover 16, the cam 45 and the arm 46 described above are jointed with one another at the rotation shaft 16A, the rotation axis 46A, the rotation axis 46B and the rotation axis 45A to form a four-segmented linker. Thereby, the cam 45 is enabled to rotate along with the outlet cover 16 when the user opens or closes the outlet cover 16.

The position of the rotation axis 46B, at which the arm 46 and the cam 45 are jointed with each other, stays to be lower at all times, whether the outlet cover 16 is opened or closed, than a position of the rotation axis 46B when the arm 46 and the cam 45 are fully extended with respect to each other, that is, a position of a so-called dead point of the rotation axis 46B when the rotation axes 46A, 46B and 45A are extended to align linearly. Therefore, the rotation axis 46B between the arm 46 and the cam 45 is restricted from being moved to the dead point or to an upper position with respect to the dead point at least by the weights of the arm 46 and the cam 45.

The cam 45 can be rotated and switched between a state, in which the cam 45 contacts the contact surface 43B of the flapper 43 at the first cam surface 45B, and a state, in which the cam 45 contacts the contact surface 43B of the flapper 43 at the second cam surface 45C. When the cam 45 contacts the contact surface 43B at the first cam surface 45B, the flapper 43 is rotated to move to the turnaround-open position. When the cam 45 contacts the contact surface B at the second cam surface 45B, on the other hand, the flapper 43 is rotated to move to the turnaround-closed position.

In conjunction with the opening and closing motions of the outlet cover 16, a rotation angle of the cam 45 is changed. In this regard, as mentioned above, the first cam surface 45B spreads equidistantly from the rotation axis 45A, while the second cam surface 45C coaxially spreads equidistantly from the rotation axis 45A. Therefore, even when the first cam surface 45B slidably rotates with respect to the contact surface 43B and the rotation angle of the cam 45 changes for a certain amount, that is, as long as the first cam surface 45B maintains the contact with the contact surface 43B, the flapper 43 is not rotated. In the same reason, even when the second cam surface 45C slidably rotates with respect to the contact surface 43B and a rotation angle of the cam 45 changes for a certain amount, that is, as long as the second cam surface 45C maintains the contact with the contact surface 43B, the flapper 43 is not rotated.

In other words, if the outlet cover 16 and the flapper 43 are directly connected by the four-segmented linker, the position of the outlet cover 16 and the position of the flapper 43 are moved with respect to each other on one-on-one correspondence. Therefore, even a small amount of movement in the outlet cover 16 is immediately transmitted to the flapper 43 to move the flapper 43. On the other hand, with the above-described structure having the two-phased cam 45, while the outlet cover 16 and the cam 45 are linked with each other by the four-segmented linker, the position of the outlet cover 16 and the position of the flapper 43 are not directly affected by each other. Therefore, even when the outlet cover 16 is moved to for the small amount, as long as the contact surface 43B of the flapper 43 is contacted by the one of the two cam surfaces 45B, 45C, the flapper 43 is restricted from being rotated.

Thus, even when the outlet cover 16 is opened for a small amount from the closed position, the contact between the contact surface 43B of the flapper 43 and the first cam surface 45B of the cam 45 is maintained. Therefore, the flapper 43 is restricted from being moved from the turnaround-closed position. Meanwhile, even when the outlet cover 16 is moved toward the closed position for a small amount from the open position, the contact between the contact surface 43B of the flapper 43 and the second cam surface 45C is maintained. Therefore, the flapper 43 is restricted from being moved from the turnaround-closed position. Further, even when the relative position between the outlet cover 16 and the cam 45 is varied within a tolerable range, the rotation angle of the cam 45 is maintained unaffected. Thus, the flapper 43 can be placed in the turnaround-open position and the turnaround-closed position correctly. Accordingly, jam of the original document in the first ejection path and the second ejection path due to misalignment of the flapper 43 can be prevented or restricted. When the outlet cover 16 is open to full extent thereof, the position of the outlet cover 16 is maintained thereat with a lower end thereof being in contact with a downstream end 47A of a guide plate 47 (see FIG. 11).

Figure 13:
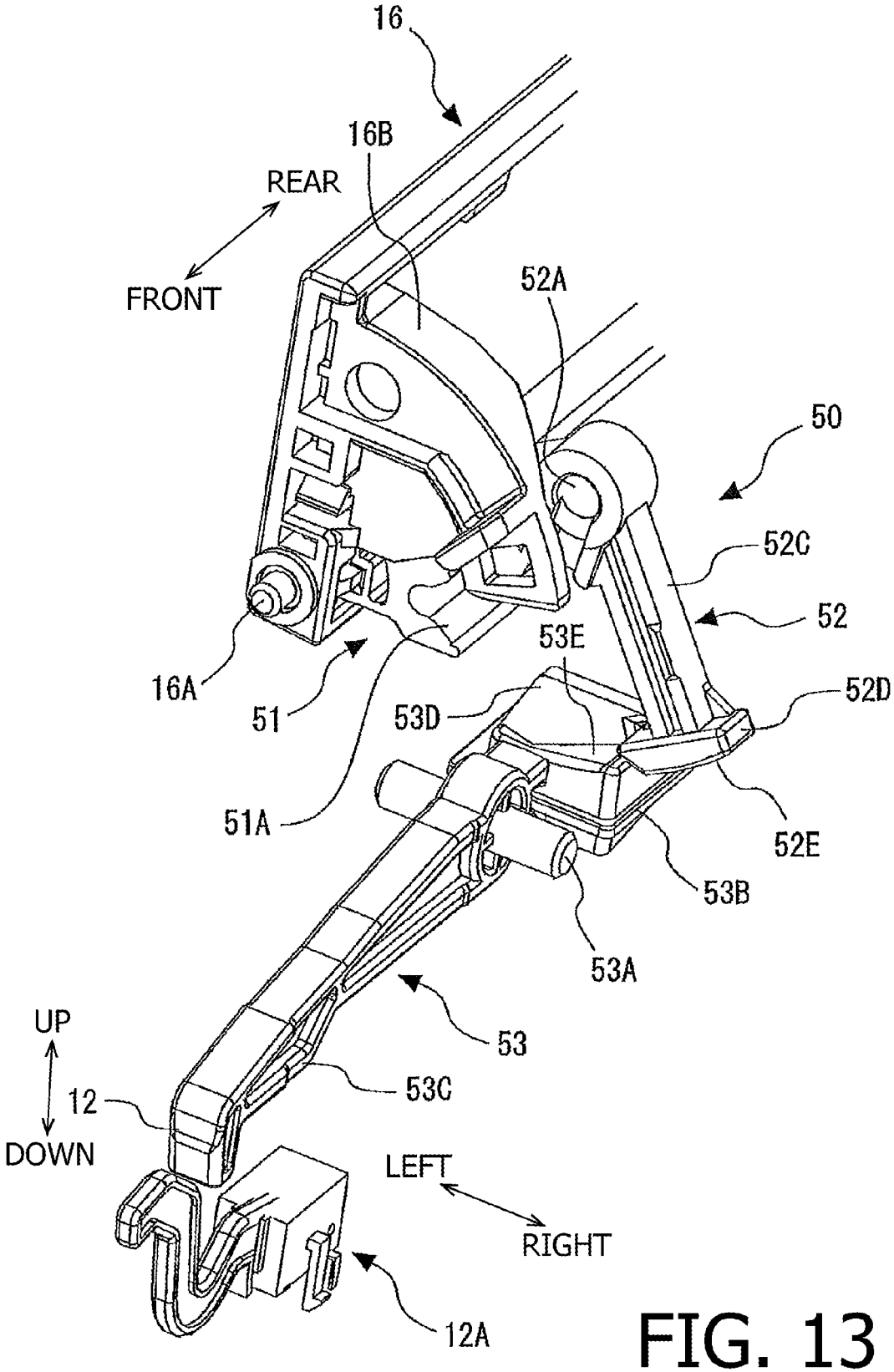
FIG. 13 is an illustrative view of a linkage mechanism when the outlet cover is closed in the MFD according to the embodiment of the present invention.
Figure 14:
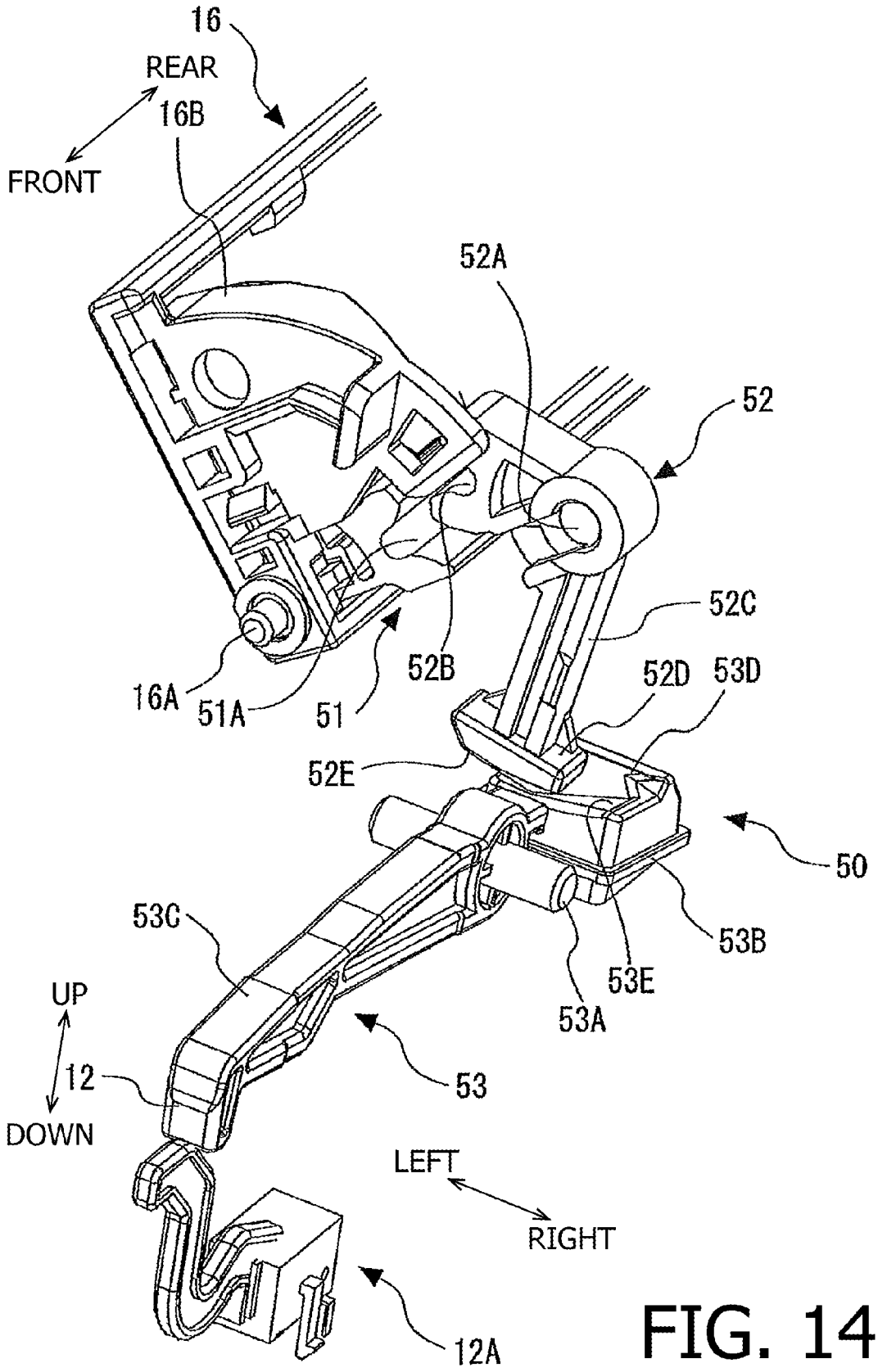
FIG. 14 is an illustrative view of the linkage mechanism when the outlet cover is open in the MFD according to the embodiment of the present invention.

Meanwhile, as depicted in FIGS. 12-14, inside the outlet cover 16, on a front side, a cover motion detector 50 is provided. The cover motion detector 50 moves one of the sensor-manipulative tips 11, 12, in particular, the sensor-manipulative tip 12, to rotate in conjunction with the opening and closing motions of the outlet cover 16. The sensor-manipulative tip 12 is rotatable in between a lower position (see FIG. 13) and an upper position (see FIG. 14). While the flapper 43 is restricted from being moved from the turnaround-open position even when the outlet cover 16 is moved from the closed position for a small amount, the cover motion detector 50 moves the sensor-manipulative tip 12 from the lower position toward the upper position immediately when the outlet cover 16 is moved from the closed position for the small amount. Detailed behaviors of the cover motion detector 50 and the sensor-manipulative tip 12 will be described below.

That is, as depicted in FIGS. 12 and 13, the cover motion detector 50 includes a gear piece 51, a switch arm 52 and a terminal arm 53. The gear piece 51 is arranged on an inner side of casing 4A of the document conveyer unit 4 with respect to the outlet cover 16 and in a frontward position in proximity to the rotation shaft 16A of the outlet cover 16. The switch arm 52 is meshed with the gear piece 51. The terminal arm 53 is engaged with the switch arm 52. On a tip end of the terminal arm 53, which is a frontward end of the terminal arm 53, the sensor-manipulative tip 12 is integrally formed. In a lower position with respect to the sensor-manipulative tip 12, the motion-detective sensor 12A being an actuator is disposed. The other one of the sensor-manipulative tips 11, 12, i.e., the sensor-manipulative tip 11, is movably supported by a casing 3A of the reader unit 3 to move vertically. In a lower position with respect to the sensor-manipulative tip 11, the motion-detective sensor 11A being an actuator is disposed. The motion-detective sensors 11A, 12A are, as depicted in FIGS. 8 and 9, disposed in the main unit 2, and signals indicating ON and OFF from the motion-detective sensors 11A, 12A are output to the controller of the main unit 2.

The gear piece 51 is movable along with the opening and closing motions of the outlet cover 16. The gear piece 51 is formed to have a driving-side dent 51A. The gear piece 51 is arranged to protrude inwardly with respect to an inner surface of the outlet cover 16 in a posture to have the driving-side dent 51A to orient substantially upward when the outlet cover 16 is opened.

The switch arm 52 is formed to have a shaft 52A, a driven-side dent 52B (see FIG. 14), a rod 52C and a handler 52D integrally. The shaft 52A is supported in a bearing (not shown), which is disposed in the document conveyer unit 4. A portion surrounding the driven-side dent 52B relatively protrudes toward the gear piece 51 and is engaged with the driving-side dent 51A. The rod 52C extends downwardly from the shaft 52A. The handler 52D is formed at a lower end of the rod 52C.

When the outlet cover 16 is closed, as depicted in FIG. 13, the rod 52C is placed in a downward-oblique posture to have the handler 52D to be farther from the outlet cover 16. In this posture, the handler 52D is separated from a handler receiver 53 of the terminal arm 53. The handler receiver 53B will be described later in detail. Meanwhile, when the outlet cover 16 is open and the driving-side dent 51A of the gear piece 51 is in an upward-oblique posture, as depicted in FIG. 14, the driven-side dent 52B is placed in a substantially horizontal posture. In this regard, the rod 52C is placed in a downward-oblique posture to have the handler 52D to be closer to the outlet cover 16, compared to the position of the handler 52D when the outlet cover 16 is closed.

The terminal arm 53 is integrally formed to have a shaft 53A, the handler receiver 53B, an arm portion 53C and an upright wall 53D. The shaft 53A of the terminal arm 53 is rotatably supported by a bearing 3B, which is disposed in the reader unit 3. The terminal arm 53 is therefore rotatable about the shaft 53A being a rotation axis of the terminal arm 53. The handler receiver 53B is arranged to project inwardly toward the rear side of the MFD 1 with respect to the shaft 53A inside the reader unit 3 and to contact the handler 52D of the switch arm 52. The arm portion 53C is arranged to project outwardly toward the front side of the MFD 1 with respect to the shaft 53A. The upright wall 53D is formed along a rear edge of the handler receiver 53B to rise substantially vertically.

The handler receiver 53B of the terminal arm 53 is arranged to have an inclined upper surface 53E thereof to contact a bottom surface 52E of the handler 52D of the switch arm 52. The bottom surface 52E of the handler 52D forms a convex, which protrudes downwardly in a shape of an arc, which centers about the shaft 52A. Meanwhile, the inclined supper surface 53E of the handler receiver 53B forms a concave, of which depth is smaller than a protrusive amount of the arc of the bottom surface 52E of the handler 52D but is substantially deep to receive the handler 52D thereat. Therefore, when the outlet cover 16 is moved to from the closed position shown in FIG. 13 to the open position shown in FIG. 14, the handler 52D of the switch arm 52 swings and contacts the handler receiver 53B along the inclination of the concave. As the handler 52D of the switch arm 52 swings about the shaft 52A, the handler 52D is restricted from swinging at a displaced position from the 53E but is guided by the upright wall 53D to be coupled with the upper surface 53E of the terminal arm 53 stably. Thus, the handler 52D of the switch arm 52 is coupled to the handler receiver 53B and presses the handler receiver 53B downward. Accordingly, the sensor-manipulative tip 12 in the terminal arm 53 is moved to rotate about the shaft 53A upwardly from the lower position to the upper position.

In this regard, a projecting amount of the arm portion 53C and the sensor-manipulative tip 12 projecting frontward from the shaft 53A is greater than a projecting amount of the handler receiver 53B projecting rearward from the shaft 53A. In other words, the shaft 53A being the rotation axis of the terminal arm 53 is arranged in a position closer to the handler receiver 53B with respect to a longitudinal center of the terminal arm 53 between the handler receiver 53B and the sensor-manipulative tip 12. Therefore, in the terminal arm 53, a greater rotation amount, with respect to a rotation amount of the handler receiver 53B, is provided to the sensor-manipulative tip 12. In the present embodiment, a ratio of the projecting amount from the shaft 53A to the handler receiver 53B, i.e., a distance between the rotation axis and the point of effort, with respect to the projecting amount from the shaft 53A to the sensor-manipulative tip 12, i.e., a distance between the rotation axis and the point of load, is approximately 1:4. In this regard, a ratio of a distance between the shaft 52A of the switch arm 52 and the bottom 52E with respect to a distance between the shaft 53A and the sensor-manipulative tip 12 is approximately 1:2. However, these ratios are not limited to the figures described above but may vary in consideration of, for example, widths of the outlet cover 16 and the document conveyer unit 4 and/or heights of the reader unit 3 and the document conveyer unit 4. Further, in the present embodiment, the terminal arm 53 is urged by an urging force, which may be provided by, for example, a coil spring (not shown), to have the sensor-manipulative tip 12 placed initially in the lower position. However, by utilizing the difference in distances within the terminal arm 53, that is, by utilizing weight balance within the terminal arm 53, the sensor-manipulative tip 12 may be placed initially in the lower position by its own weight.

In the MFD 1 configured as above, when an original document in a size larger than a predetermined size (e.g., a standardized B5 size or A4 size) is conveyed, the outlet cover 16 is closed to place the flapper 43 in the turnaround-open position. Thereby, the first ejection path is established in the document conveyer unit 4. Meanwhile, when an original document in a size smaller than the predetermined size (e.g., a postcard or a business card) is conveyed, the outlet cover 16 is opened to place the flapper 43 in the turnaround-closed position. Thereby, the second ejection path 44 is provided in the document conveyer unit 4.

The original document to be conveyed is set in between the paired guiding pieces 15, and an instruction for scanning or copying is inputted in the MFD 1 by the user through the operation unit 10 or remotely, for example, through a personal computer (not shown). When the instruction is inputted, the user may specifically instruct the MFD 1 to execute a single-face reading to read a single side of the original document or a double-face reading to read both sides of the original document.

When the instruction for scanning or copying is entered, the MFD 1 executes a process to initialize each necessary unit in the MFD 1 and activates the rollers in the document conveyer unit 4. Accordingly, the original documents fed from the upstream side along the conveying direction are separated one-by-one by the separator roller 34 and conveyed further toward the downstream.

When a leading end of the original document abuts the pared conveyer rollers 35 (FIG. 8), a position of the original document is registered, and a skew orientation of the original document is corrected. Thus, the original document is further conveyed to the downstream to pass through a position between the platen 13 and the first document presser 28. If the user instructed the single-face reading or the double-face reading, when the original document is conveyed to a position to face the first image sensor 21, the controller manipulates the first image sensor 21 to read an image appearing on the lower side of the original document. It is noted that, when the single-face reading is instructed, the original document is placed on the document placement surface 4B with the side containing the image to be read facing downward, and if a plurality of original documents are placed, the original documents are conveyed sequentially in a bottom-to-top order.

Meanwhile, the first image sensor 21 repeats reading a plurality of pixels aligning along a main scanning direction while the original document is conveyed through the position to face the first image sensor 21 along the conveying direction. Thus, the image appearing on the lower side of the original document is read. In this regard, the main scanning direction is a direction in parallel with the front-rear direction of the MFD 1, whereas the conveying direction is equal to the sub-scanning direction.

The original document passed through the position between the platen 13 and the first document presser 28 is further conveyed to pass through a position between the second platen 27 and the second document presser 30. If the user instructed the double-face reading or the single-face reading by the second image sensor 22, when the original document is conveyed to a position to face the second image sensor 22, the controller manipulates the second image sensor 22 to read an image appearing on the upper side of the original document. It is noted that, when the single-face reading by the second image sensor 22 is instructed, the original document is placed on the document placement surface 4B with the side containing the image to be read facing upward, and if a plurality of original documents are placed, the original documents are conveyed sequentially in the bottom-to-top order.

Meanwhile, the second image sensor 22 repeats reading a plurality of pixels aligning along the main scanning direction while the original document is conveyed through the position to face the second image sensor 22 along the conveying direction. Thus, the image appearing on the upper side of the original document is read. In this regard, the main scanning direction is the direction in parallel with the front-rear direction of the MFD 1, whereas the conveying direction is equal to the sub-scanning direction.

The original document passed through the position between the second platen 27 and the second document presser 30 reaches the turnaround-driving roller 36 and is conveyed from a lower-end position to a leftward position with respect to the turnaround-driving roller 36.

In this regard, if the first ejection path is established to be used as the documents conveyer path, that is, when the flapper 43 is in the turnaround-open position, as depicted in FIG. 8, the flapper 43 serves as a bulkhead to partition the document reversible path 41 and the second ejection path 44 from each other. As depicted in FIG. 8, when the flapper 43 is in the position to close the second ejection path 44, a curve formed on the right-hand side of the flapper 43 is arranged along an outer circumference of the turnaround-driving roller 36 with a clearance maintained in there-between. Thereby, when the original document is conveyed from the lower-end position of the turnaround-driving roller 36 along with the rotation of the turnaround-driving roller 36, the curve formed in the flapper 43 serves as a guiding surface to guide the leading end of the original document upward in conjunction with the turnaround-driving roller 36.

The original document directed upward by the guiding surface is turned around along the circumference of the turnaround-driving roller 36 and conveyed in the first ejection path ranging from the document reversible path 41 to the document ejection path 42. The original document conveyed through the first ejection path is ejected and collected on top of the upper document cover 20. When ejected, a tail end of the original document may rest on top of the paired guiding pieces 15; that is, the paired guiding piece may serve as a part of a document ejecting section. Therefore, in the present embodiment, an ejecting section, in which the original document having been conveyed through the first ejection path is ejected, serves as the top surface of the upper document cover 20 or at least a part of the document ejection path 42, which ranges from the top surface of the upper document cover 20 to the top part of the paired guiding pieces 15.

On the other hand, if the second ejection path 44 is open to be used as the document conveyer path, that is, when the flapper 43 is in the turnaround-closed position, as depicted in FIG. 9, the flapper 43 is rotated to release the second ejection path 44. In other words, the flapper 43 is rotated to place the lower end thereof (in FIG. 8) in an upper position with respect to an entry of the second ejection path 44. Thereby, the document reading path 40 and the second ejection path 44 are connected at the position below the flapper 43 to communicate with each other. In this state, when the original document is conveyed from the lower-end position of the turnaround-driving roller 36 toward the downstream, i.e., leftward in FIG. 9, the leading end of the original document passes through the position below the flapper 43. In this regard, a width of the second ejection path 44 along the front-rear direction of the main unit 2, i.e., a dimension of the second ejection path 44 along a direction orthogonal with respect to the conveying direction, may only be large enough to allow an original document having a width smaller than or equal to the predetermined threshold width to pass there-through.

The original document passed through the position below the flapper 43 is conveyed in the second ejection path 44 and ejected through the document outlet 17, which is formed on the left-hand side of the document conveyer unit 4. The ejected original document is collected in the outlet cover 16, which serves as the ejection tray.

Meanwhile, the MFD 1 is enabled to read an image appearing on an original document, which is placed still on the platen 13. In order to manipulate the MFD 1 to read the image from the placed-still original document, the user opens the document conveyer unit 4 with respect to the reader unit 3 and places the original document on the platen 13 being the document placement plane. With the original document placed still on the platen 13, the user inputs an instruction for scanning or copying in the MFD 1 through the operation unit 10 or remotely, for example, through a personal computer (not shown).

When the instruction for scanning or copying is entered, the MFD 1 executes a process to initialize each necessary unit in the MFD 1 and manipulates the first image sensor 21 to read the image appearing on the original document. In particular, the first image sensor 21 is moved along a sub-scanning direction and repeats reading a plurality of pixels aligning on the original document along a main scanning direction. In this regard, the main scanning direction is a direction in parallel with the front-rear direction of the MFD 1, whereas the crosswise direction is equal to the sub-scanning direction.

[Detecting Mechanism for Open/Close Motions of the Outlet Cover]

Figure 7:
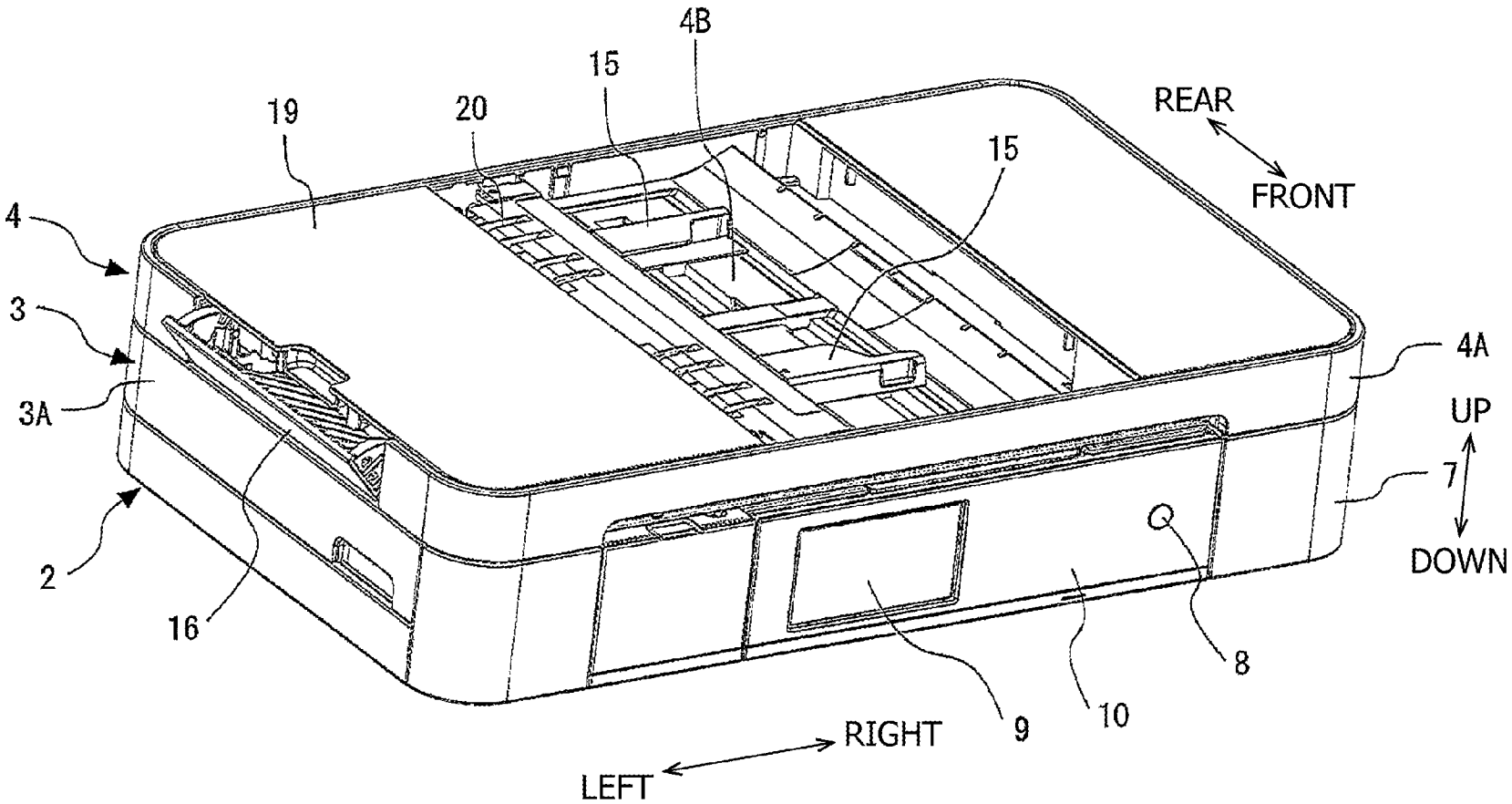
FIG. 7 is a perspective view of the document conveyer unit and the MFD according to the embodiment of the present invention with a document placement cover being removed from the document conveyer unit.

Next, a detecting mechanism to detect the opening motion of the outlet cover 16 in the MFD 1 will be described. The MFD 1 has a plurality of openable/closable structures, which enable to place the MFD 1 in various patterns of open/closed postures. For example, the MFD 1 may be placed in an all-closed state (see FIG. 1), in which the openable/closable structures are closed; an open state for the reader unit 3 (see FIG. 2), in which the reader unit 3 together with the document conveyer unit 4 is open; an open state for the document conveyer unit 4 (see FIG. 3), in which the document conveyer unit 4 is open; and an open state for the outlet cover 16 (see FIGS. 5-7), in which the outlet cover 16 is open. In the following description, opening/closing motions of the document placement cover 14 will not be considered.

In the present embodiment, as depicted in FIG. 3, the document conveyer unit 4 is provided with a manipulative projection 4C at a bottom thereof. The manipulative projection 4C is arranged to contact the sensor-manipulative tip 11 through an insertion hole 3C formed in the reader unit 3. When the user closes the document conveyer unit 4 with respect to the reader unit 3, the manipulative projection 4C in the document conveyer unit 4 presses the sensor-manipulative tip 11 downward to place the sensor-manipulative tip 11 in the lower position. Meanwhile, when the user opens the document conveyer unit 4 with respect to the reader unit 3, the manipulative projection 4C in the document conveyer unit 4 is separated from the sensor-manipulative tip 11. In this regard, the sensor-manipulative tip 11 is urged upward by an urging force provided by an urging member (not shown) and moved to the upper position. As depicted in FIG. 2, when the user opens the reader unit 3 with respect to the main unit 2, the sensor-manipulative tip 11 is moved upward together with the reader unit 3. In this regard, the sensor-manipulative tip 11 stays in the lower position with respect to the reader unit 3.

On the other hand, as mentioned above, the sensor-manipulative tip 12 in the terminal arm 53 is moved upward to the upper position when the outlet cover 16 is opened. While the terminal arm 53 is supported by the reader unit 4, when the outlet cover 16 is closed or when the document conveyer unit 4 alone is opened, the terminal arm 53 is not moved but stays in the lower position.

Therefore, when the MFD 1 is in the all-closed state shown in FIG. 1, the sensor-manipulative tips 11, 12 are both in the lower positions. In this regard, the motion-detective sensors 11A, 12A both output signals indicating "ON" to the controller in the main unit 2. When the user opens the output cover 16 alone with respect to the document conveyer unit 4 (FIGS. 5-7), the sensor-manipulative tip 12 alone is moved from the lower position to the upper position. In this regard, the motion-detective sensor 11A outputs the signals indicating "ON" to the controller while the motion-detective sensor 12A outputs signals indicating "OFF" to the controller. When the user opens the document conveyer unit 4 alone with respect to the reader unit 3 (FIG. 3), the sensor-manipulative tip 11 alone is moved from the lower position to the upper position. In this regard, the motion-detective sensor 11A outputs the signals indicating "OFF" to the controller while the motion-detective sensor 12A outputs the signals indicating "ON" to the controller. When the user opens the reader unit 3, together with the document conveyer unit 4, with respect to the main unit 2 (FIG. 2), the sensor-manipulative tips 11, 12 are both moved upward together with the reader unit 3 but stay in their lower positions respectively. In this regard, the motion-detective sensors 11A, 12A both output the signals indicating "OFF" to the controller in the main unit 2.

Thus, by multiplying the combination of the positions of the two sensor-manipulative tips 11, 12 by the combination of ON/OFF signals output by the two motion-detective sensors 11A, 12A, four open/close patterns of the reader unit 3, the document conveyer unit 4, and the outlet cover 16 can be detected by the two motion-detective sensors 11A, 12A. In this regard, it is to be noted that the combination of the ON/OFF signals and the positions of the sensor-manipulative tips 11, 12 may not necessarily be limited to the correspondence described above, but may be changed as long as the four patterns are distinguished.

Figure 15:
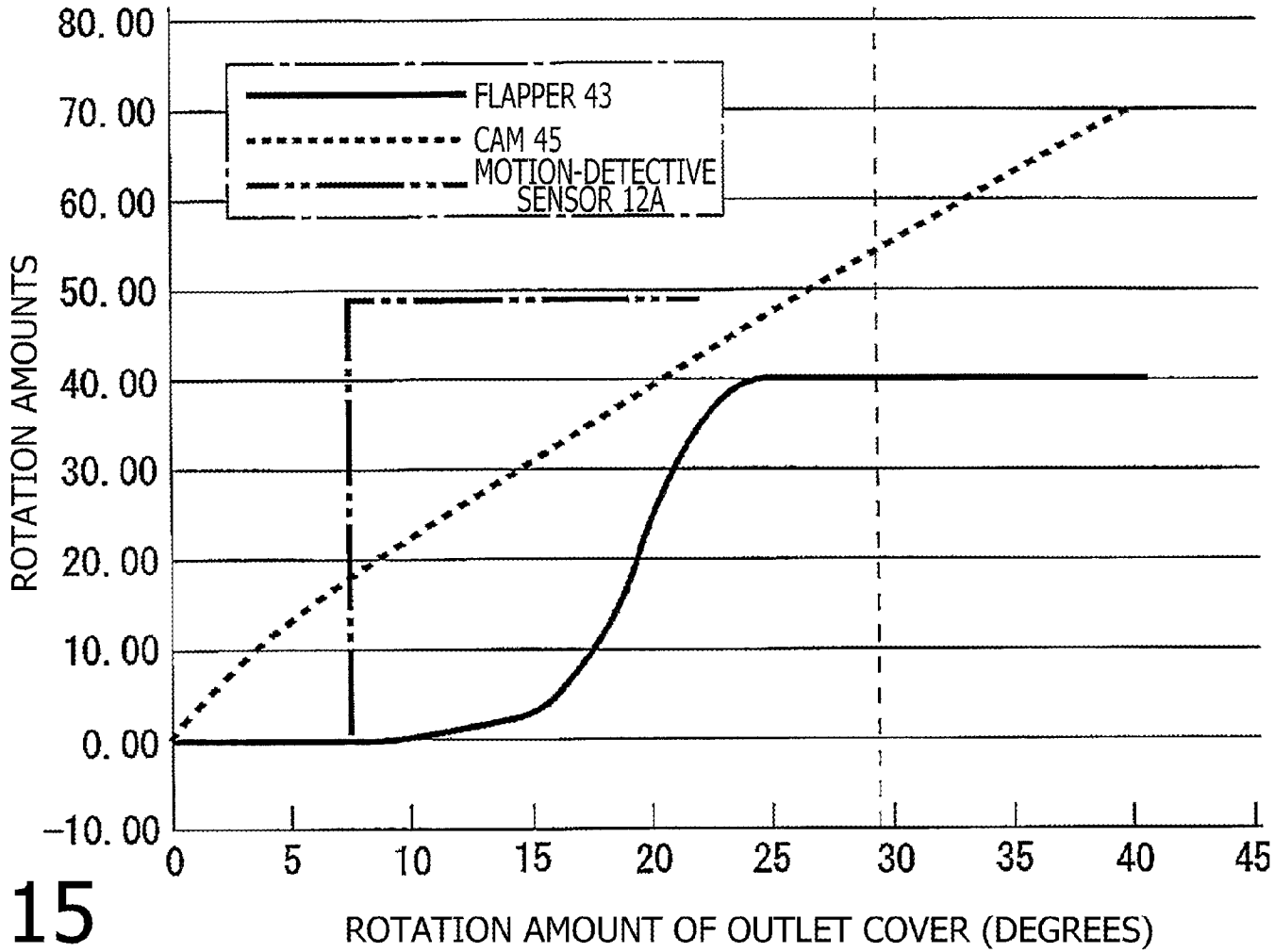
FIG. 15 is a graph to illustrate relationship between rotating timings of the flapper and detectable timings of the opening motion of the outlet cover in the MFD according to the embodiment of the present invention.

As mentioned above, the motion-detective sensor 12A changes the ON/OFF signals to output when the outlet cover 16 is moved from the closed position even for a small amount while the flapper 43 is arranged not to move from the turn-around-open position when the outlet cover 16 is moved from the closed position for the small amount. Thus, as depicted in a graph shown in FIG. 15, a timing to start rotating the flapper 43 can be delayed with respect to a timing to start rotating the cam 45. Further, as indicated by a double-dotted chain line in FIG. 15, the timing to start rotating the flapper 43 can be even delayed to be later than a timing to change the ON/OFF signals output from the motion-detective sensor 12A. In other words, the motion-detective sensor 12A can detect the opening motion of the output cover 16 before the flapper 43 starts rotating.

Accordingly, for example, when the user attempts to start reading an image from the original document, and when the width-detectable sensor (not shown) detects a width of the original document placed on the document placement surface 4B in the document conveyer unit 4 being greater than the predetermined threshold width, there may be a case that the outlet cover 16 is already in the open position. In such a case, the controller can recognize the state of the outlet cover 16 being open based on the signals output from the motion-detective sensor 12A before image reading starts. Further, there may be a case, even if the outlet cover 16 is initially closed, that the outlet cover 16 is intentionally or unintentionally opened while the image is about to be read or being read. In such a case, the controller can recognize the state of the outlet cover 16 being opened based on the signals output from the motion-detective sensor 12A at an early stage of the opening motion of the outlet cover 16, i.e., before the flapper 43 starts switching the conveying paths from the first ejection path to the second ejection path 44.

Thus, when the outlet cover 16 already in the open position is detected before the image starts to be read, the controller can control the MFD 1 not to start reading the image. Meanwhile, when the outlet cover 16 being opened is detected while the image is about to be read or being read, the controller can control the rollers 33-36 to stop rotating. Thus, the original document with the larger width is restricted from being drawn into the second ejection path 44, and undesirable events such as the original document being damaged or jammed can be prevented.

Although an example of carrying out the invention has been described, those skilled in the art will appreciate that there are numerous variations and permutations of the image reading apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the cover motion detector 50 to detect the opening motion of the outlet cover 16 may not necessarily be limited to the linkage mechanism having the gear piece 51, the switch arm 52 and the terminal arm 53, but may be configured with a plurality of gears, of which diameters and gear ratios are adjusted to control the detective timings. For another example, in a case where the width of the original document being smaller than or equal to the predetermined threshold width is detected, and when the controller detects no opening motion or opened state of the outlet cover 16 based on the signals from the motion-detective sensor 12A, the controller may control the MFD 1 not to convey or feed the original document.

It may be noted that, as long as the controller may only detect the opening motion of the outlet cover 16 before the flapper 43 starts rotating, the opening motion of the outlet cover 16 may be directly detected by, for example, an additional sensor disposed in proximity to the outlet cover 16. However, according to the embodiment described above, no wire arrangement for the additional sensor or no extra space to accommodate the additional sensor is required. Rather, in the embodiment described above, an internal space inside the document conveyer unit 4, i.e., a lower area with respect to the outlet cover 16 and an outer area with respect to the lower area (i.e., a frontward area of the MFD 1), is effectively provided, and the conveying paths are prevented from being interfered with by the cover motion detector 50. For another example, the opening motion of the outlet cover 16 may not necessarily be detected directly by the cover motion detector 50 but may be detected indirectly by using the linkage mechanism connected with the flapper 43.

For another example, the document conveyer unit 4 may not necessarily invert the original document by conveying in the reversible path 41 from the lower position to the upper position but may invert from the upper position to the lower position. In the top-to-bottom inverting arrangement, it may be necessary that the second image sensor 22 is disposed in an upstream position with respect to the reversible path 41 along the conveying direction. In this regard, if the second image sensor 22 is disposed in a downward-facing posture in an upper position with respect to the conveying path for feeding, a height of the document conveyer unit 4 may be increased. Therefore, in order to maintain the height of the document conveyer unit 4, it is preferable that the second image sensor 22 is disposed in an upward-facing posture.

For another example, in the embodiment described above, when the instruction for scanning or copying is entered while the original document is placed in between the paired guiding pieces 15, the operation to scan the automatically conveyed original document conveyed by the document conveyer unit 4 is started. However, it may not necessarily that use of the document conveyer unit 4 is automatically selected, but the user may be allowed to specifically select whether the document conveyer unit 4 should be used or not used upon entering the instruction.

As described above, according to the present invention, an image reading apparatus is provided. The image reading apparatus includes a casing having a sheet path, which includes a first ejection path and a second ejection path; a sheet placement section configured to receive a sheet to be read; an image reader configured to read an image from the sheet; a conveyer mechanism configured to convey the sheet from the sheet placement section through the image reader to one of the first ejection path and the second ejection path; an outlet cover arranged on the casing and configured to be movable between a closed position, in which an outlet of the second ejection path is closed by the outlet cover, and an open position, in which the outlet of the second ejection path is exposed; a path switchable member arranged in a branch point between the first ejection path and the second ejection path and configured to be movable to switch the sheet path for the sheet conveyed through the reader unit from one of the first ejection path and the second ejection path to the other of the first ejection path and the second ejection path; a signal output device configured to output signals including a first-typed signal and a second-typed signal being a different-typed signal from the first-typed signal, the signal output device being configured to output the first-typed signal when the outlet cover is in the closed position and to output the second-typed signal when the outlet cover is in the open position; a first movable unit arranged in a position between the outlet cover and path switchable member and configured to move the path switchable member in accordance with motions of the path switchable member moving between the open position and the closed position; and a second movable unit arranged in a position between the outlet cover and the signal output device and configured to move in accordance with the motions of the path switchable member moving between the open position and the closed position to switch the signals output from the signal output device from the first-typed signal to the second-typed signal. When the outlet cover starts moving from the closed position to the open position and before the sheet path is switched by the first movable unit moving the path switchable member from the first ejection path to the second ejection path, the second movable unit moves in accordance with the motion of the path switchable member to switch the signals to be output from the signal output device from the first-typed signal to the second-typed signal.

According to the configuration described above, the sheet can be restricted from being damaged or jammed in the sheet path.

What is claimed is:

1. An image reading apparatus, comprising:

a casing comprising a sheet path, which includes a first ejection path and a second ejection path;

a sheet placement section configured to receive a sheet to be read;

an image reader configured to read an image from the sheet;

a conveyer mechanism configured to convey the sheet from the sheet placement section through the image reader to one of the first ejection path and the second ejection path;

an outlet cover arranged on the casing and configured to be movable between a closed position, in which an outlet of the second ejection path is closed by the outlet cover, and an open position, in which the outlet of the second ejection path is exposed;

a path switchable member arranged in a branch point between the first ejection path and the second ejection path and configured to be movable to switch the sheet path for the sheet conveyed through the image reader from one of the first ejection path and the second ejection path to the other of the first ejection path and the second ejection path;

a signal output device configured to output signals including a first-typed signal and a second-typed signal being a different-typed signal from the first-typed signal, the signal output device being configured to output the first-typed signal when the outlet cover is in the closed position and to output the second-typed signal when the outlet cover is in the open position;

a first movable unit arranged in a position between the outlet cover and the path switchable member and configured to move the path switchable member in accordance with motions of the path switchable member moving between the open position and the closed position; and a second movable unit arranged in a position between the outlet cover and the signal output device and configured to move in accordance with the motions of the path switchable member moving between the open position and the closed position to switch the signals output from the signal output device from the first-typed signal to the second-typed signal, wherein, when the outlet cover starts moving from the closed position to the open position and before the sheet path is switched by the first movable unit moving the path switchable member from the first ejection path to the second ejection path, the second movable unit moves in accordance with the motion of the path switchable member to switch the signals to be output from the signal output device from the first-typed signal to the second-typed signal.

2. The image reading apparatus according to claim 1, wherein the first movable unit comprises an arm member and a cam member having an extended part;

wherein one end of the arm member is rotatably coupled to the outlet cover, and another end of the arm member is rotatably coupled to the extended part of the cam member;

wherein the path switchable member comprises a flapper member, which is arranged to contact a circumference of the cam member and is configured to be movable to switch the sheet path from one of the first ejection path and the second ejection path to the other of the first ejection path and the second ejection path;

wherein the second movable unit comprises a gear member, a switch arm and a terminal arm;

wherein the gear member is arranged on an inner side of the casing with respect to the outlet cover, one end of the switch arm being engaged with one end of the gear member, one end of the terminal arm being coupled with another end of the switch arm, and another end of the terminal arm is provided with a sensor manipulative tip which is configured to manipulate the signal output device; and wherein a rotation axis of the terminal arm is arranged in a position closer to the one end of the terminal arm with respect to a longitudinal center of the terminal arm.

3. The image reading apparatus according to claim 2, wherein the cam member comprises a first cam surface forming an arc and a second cam surface forming an arc; and wherein a distance between a rotation axis of the cam member and the first cam surface is greater than a distance between the rotation axis of the cam member and the second cam surface.

4. The image reading apparatus according to claim 3, wherein, when the flapper member contacts a circumference of the first cam surface, the sheet path is switched to the first ejection path, and when the flapper member contacts a circumference of the second cam surface, the sheet path is switched to the second ejection path; and wherein, when the outlet cover starts moving from the closed position to the open position and after the signals output from the signal output device are switched from the first-typed signal to the second-typed signal by the second movable unit, the flapper member having contacted the circumference of the first cam surface shifts to contact the circumference of the second cam surface.

5. The image reading apparatus according to claim 1, wherein a dimension of the first ejection path along an orthogonal direction, which is orthogonal with respect to a direction to convey the sheet, is greater than a dimension of the second ejection path along the orthogonal direction.

* * * * *